US012623828B2

(12) United States Patent
Corbin et al.

(10) Patent No.: US 12,623,828 B2
(45) Date of Patent: May 12, 2026

(54) INSULATING CONTAINER

(71) Applicant: YETI Coolers, LLC, Austin, TX (US)

(72) Inventors: Matthew Shaffer Corbin, San Antonio, TX (US); Chris Franks, Austin, TX (US); Corey Levin, Austin, TX (US); John Warren Dow, Austin, TX (US); Nicolai Marcel Luksza, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 18/624,534

(22) Filed: Apr. 2, 2024

(65) Prior Publication Data

US 2025/0304356 A1 Oct. 2, 2025

(51) Int. Cl.

| | |
|---|---|
| ***B65D 81/38*** | (2006.01) |
| ***B65D 25/28*** | (2006.01) |
| ***B65D 43/16*** | (2006.01) |
| ***B65D 81/26*** | (2006.01) |

(52) U.S. Cl.

CPC ..... *B65D 81/3813* (2013.01); *B65D 25/2873* (2013.01); *B65D 43/16* (2013.01); *B65D 81/261* (2013.01)

(58) Field of Classification Search

CPC ..... B65D 81/3813; B65D 81/3825; B65D 81/3816; B65D 81/3818; B65D 25/2873

USPC ..... 220/592.2, 754, 757, 760, 776

See application file for complete search history.

(56) References Cited

U.S. PATENT DOCUMENTS

| | | | |
|---|---|---|---|
| 3,220,048 | A | 11/1965 | Wei |
| 3,406,433 | A | 10/1968 | Frey |
| 4,351,165 | A | 9/1982 | Gottsegen et al. |
| 4,370,040 | A | 1/1983 | Lange |
| 4,436,214 | A | 3/1984 | Henderson |
| 4,493,268 | A | 1/1985 | Sidler |
| 4,660,751 | A | 4/1987 | von Dewitz |
| 4,763,763 | A | 8/1988 | Sadow |

(Continued)

FOREIGN PATENT DOCUMENTS

| | | |
|---|---|---|
| CN | 202525404 U | 11/2012 |
| CN | 308635020 | 5/2024 |

(Continued)

OTHER PUBLICATIONS

Nov. 25, 2024—(AU) Formalities Notice No. 1—App. No. 202417441.

(Continued)

*Primary Examiner* — Robert Poon

(74) *Attorney, Agent, or Firm* — Banner & Witcoff, Ltd.

(57) ABSTRACT

An insulating container having a base and a lid is provided. The lid may be rotatable about a hinge from a closed configuration to an open configuration and may be secured, via one or more latching devices, in the closed configuration. In some examples, the insulating container further includes a strap assembly with a convertible shoulder strap and handle that can convert between a handle configuration and a shoulder strap configuration. In some examples, the insulating container further includes a removable strap assembly with a clip over button interface that includes an outer pivot post located on the lateral sidewalls of the base and a pivot clip attached to the strap with the pivot clip sliding over the outer pivot post.

19 Claims, 28 Drawing Sheets

(56) References Cited

U.S. PATENT DOCUMENTS

| | | | | |
|---|---|---|---|---|
| 5,119,910 | A * | 6/1992 | Heggeland | A45C 13/26 224/264 |
| 5,207,452 | A | 5/1993 | Collins | |
| 5,287,990 | A * | 2/1994 | Knox | B65D 25/32 220/759 |
| D355,568 | S | 2/1995 | Paulin et al. | |
| 5,429,288 | A | 7/1995 | Sattler | |
| D363,767 | S | 10/1995 | Swaim | |
| 5,713,439 | A | 2/1998 | Zionts et al. | |
| 5,816,439 | A | 10/1998 | Lovell et al. | |
| 5,870,910 | A | 2/1999 | Specht | |
| 5,950,893 | A | 9/1999 | Heggeland | |
| 6,006,974 | A | 12/1999 | Varney et al. | |
| 6,484,880 | B1 * | 11/2002 | Shaeffer | A45C 5/005 206/823 |
| 6,494,341 | B2 | 12/2002 | Perkins et al. | |
| 6,604,390 | B1 | 8/2003 | Nooner | |
| 6,666,363 | B2 * | 12/2003 | Godshaw | A45F 3/14 190/115 |
| 6,772,613 | B2 | 8/2004 | Webb et al. | |
| 6,953,214 | B2 | 10/2005 | Paz | |
| D528,368 | S | 9/2006 | Maldonado | |
| D544,757 | S | 6/2007 | Jones et al. | |
| D545,404 | S | 6/2007 | Nightlinger et al. | |
| D545,405 | S | 6/2007 | Nightlinger et al. | |
| D547,617 | S | 7/2007 | Jones et al. | |
| 7,246,718 | B2 | 7/2007 | Einav et al. | |
| 7,256,337 | B1 | 8/2007 | Walker | |
| D552,426 | S | 10/2007 | Jones et al. | |
| 7,540,363 | B2 | 6/2009 | Tonelli | |
| 7,669,299 | B2 | 3/2010 | McAnelly | |
| D613,560 | S | 4/2010 | Robichaud et al. | |
| 7,841,635 | B2 | 11/2010 | Fuchs | |
| 8,430,265 | B2 | 4/2013 | Vanderberg et al. | |
| D709,336 | S | 7/2014 | Liebenthal | |
| 9,009,931 | B2 | 4/2015 | Jensen | |
| 9,044,651 | B2 | 6/2015 | Campbell et al. | |
| 9,247,787 | B2 | 2/2016 | Dering et al. | |
| 9,320,938 | B1 | 4/2016 | Belmore | |
| 9,694,521 | B2 | 7/2017 | French et al. | |
| 9,750,371 | B2 | 9/2017 | Bungard et al. | |
| 9,756,919 | B2 * | 9/2017 | Murdoch | A45C 13/30 |
| 9,849,901 | B2 | 12/2017 | Jackman | |
| D806,483 | S | 1/2018 | Stanford et al. | |
| D807,707 | S | 1/2018 | Grepper et al. | |
| 9,919,459 | B2 | 3/2018 | French et al. | |
| 9,919,460 | B2 | 3/2018 | French et al. | |
| D815,919 | S | 4/2018 | DeFrancia | |
| 10,001,039 | B2 | 6/2018 | Shin | |
| D822,987 | S | 7/2018 | Seiders et al. | |
| D822,999 | S | 7/2018 | Seiders et al. | |
| 10,065,848 | B2 | 9/2018 | Volin | |
| D833,744 | S | 11/2018 | Yahav et al. | |
| D835,946 | S | 12/2018 | Seiders et al. | |
| D836,402 | S | 12/2018 | Jacobsen | |
| D836,995 | S | 1/2019 | Carey et al. | |
| 10,279,980 | B2 | 5/2019 | James, Jr. | |
| 10,285,480 | B2 | 5/2019 | Chovich | |
| D870,520 | S | 12/2019 | Carey et al. | |
| 10,538,365 | B2 | 1/2020 | Wood | |
| D887,699 | S | 6/2020 | Bullock et al. | |
| D887,788 | S | 6/2020 | Meda et al. | |
| D888,503 | S | 6/2020 | Meda et al. | |
| D891,193 | S | 7/2020 | Stanford et al. | |
| 10,716,388 | B2 | 7/2020 | Pellenc et al. | |
| D894,346 | S | 8/2020 | Brigham | |
| 10,731,919 | B1 | 8/2020 | Gutierrez et al. | |
| 10,766,672 | B2 | 9/2020 | Bullock et al. | |
| D899,866 | S | 10/2020 | Bullock et al. | |
| D899,867 | S | 10/2020 | Bullock et al. | |
| D899,868 | S | 10/2020 | Bullock et al. | |
| D899,869 | S | 10/2020 | Bullock et al. | |
| 10,827,808 | B2 | 11/2020 | Seiders et al. | |
| D912,705 | S | 3/2021 | Macco | |
| D922,148 | S | 6/2021 | Yang et al. | |
| D922,176 | S | 6/2021 | Bullock et al. | |
| D922,454 | S | 6/2021 | Tang | |
| D925,295 | S | 7/2021 | Bullock et al. | |
| D925,296 | S | 7/2021 | Bullock et al. | |
| D925,297 | S | 7/2021 | Bullock et al. | |
| D925,298 | S | 7/2021 | Bullock et al. | |
| 11,058,210 | B2 | 7/2021 | Lennings et al. | |
| D929,188 | S | 8/2021 | Pennington et al. | |
| D930,440 | S | 9/2021 | Astle et al. | |
| D933,464 | S | 10/2021 | Jodoin | |
| 11,180,291 | B2 | 11/2021 | Bullock et al. | |
| 11,192,008 | B2 | 12/2021 | Martell | |
| D942,219 | S | 2/2022 | Bullock et al. | |
| D942,220 | S | 2/2022 | Bullock et al. | |
| D943,355 | S | 2/2022 | Shah | |
| 11,235,908 | B2 | 2/2022 | Yockey | |
| D955,823 | S | 6/2022 | Huang et al. | |
| D958,845 | S | 7/2022 | Zhao et al. | |
| D959,918 | S | 8/2022 | Bullock et al. | |
| D962,300 | S | 8/2022 | Keetch et al. | |
| 11,414,238 | B2 | 8/2022 | Ahlström et al. | |
| D965,409 | S | 10/2022 | Bullock et al. | |
| D975,745 | S | 1/2023 | Yang et al. | |
| 11,554,901 | B2 | 1/2023 | Lesizza | |
| 11,623,796 | B2 | 4/2023 | Bullock et al. | |
| D997,650 | S | 9/2023 | Bullock et al. | |
| D999,596 | S | 9/2023 | DeFrancia | |
| D1,000,113 | S | 10/2023 | Summers | |
| D1,039,338 | S | 8/2024 | Hemenway et al. | |
| D1,040,617 | S | 9/2024 | Morris et al. | |
| 2005/0133521 | A1 | 6/2005 | Schwarz | |
| 2008/0135335 | A1 | 6/2008 | Lowman | |
| 2008/0210577 | A1 | 9/2008 | Van Handel et al. | |
| 2009/0009039 | A1 | 1/2009 | Mayes, Jr. | |
| 2009/0200347 | A1 | 8/2009 | Edralin | |
| 2009/0294455 | A1 * | 12/2009 | Pruchnicki | A45C 11/20 220/592.2 |
| 2010/0258576 | A1 | 10/2010 | Marquez | |
| 2014/0091119 | A1 | 4/2014 | Racanati | |
| 2014/0158028 | A1 | 6/2014 | Adams | |
| 2018/0010494 | A1 | 1/2018 | Cohen | |
| 2022/0097927 | A1 | 3/2022 | Seiders et al. | |
| 2022/0194654 | A1 | 6/2022 | Seiders et al. | |
| 2024/0017907 | A1 | 1/2024 | Nixon et al. | |
| 2024/0400288 | A1 * | 12/2024 | Whitworth | B65D 25/2867 |
| 2025/0136331 | A1 * | 5/2025 | Burt | A45C 13/1076 |

FOREIGN PATENT DOCUMENTS

| | | | |
|---|---|---|---|
| CN | 308878020 | | 10/2024 |
| DE | 8712251 | U1 | 10/1987 |
| EP | 0988809 | A2 | 3/2000 |
| EP | 1386557 | A1 | 2/2004 |
| GB | 821893 | A | 10/1959 |
| GB | 6297211 | | 7/2023 |
| GB | 6297462 | | 7/2023 |
| JP | 1675540 | S | 1/2021 |
| JP | 1753318 | S | 9/2023 |
| KR | 920009463 | U | 6/1992 |
| WO | 200034606 | A1 | 6/2000 |
| WO | 2023147430 | A1 | 8/2023 |
| WO | 2023220135 | A1 | 11/2023 |

OTHER PUBLICATIONS

"Roadie 24 Hard Cooler", Yeti.com, retreived: Jan. 6, 2025, published date unknown, URL: <https://www.yeti.com/coolers/hard-coolers/roadie/10022350000.html>.

Oct. 17, 2025—(TH) First Office Action—App. No. 2402003572.

Aug. 11, 2025—(KR) Notification of Refusal—App. No. DM241751-002.

Aug. 11, 2025—(KR) Notification of Refusal—App. No. DM241751-003.

Oct. 9, 2025—(TH) First Office Action—App. No. 2402005265.

Oct. 9, 2025—(TH) First Office Action—App. No. 2402005266.

Oct. 6, 2025—(CA) Notification of Refusal—App. No. 235321.

Aug. 11, 2025—(KR) Notification of Refusal—App. No. DM/241751.

(56) References Cited

OTHER PUBLICATIONS hatchmag.com, "Review: YETI Roadie 24 Hard Cooler", Hatch Magazine, published on Jun. 9, 2020, retrieved on Aug. 4, 2025 from <https://www.hatchmag.com/articles/review-yeti-roadie-24-hard-cooler/7715065>, 7 pages.
Goplus Cooler with Wheels, posted Dec. 16, 2023 [online], [retrieved May 29, 2025]. Retrieved from internet, https://www.amazon.ca/Goplus-Insulated-Portable-leak-Proof-Retention/dp/B0CP6Z22BB/ref=sr_1_55?crid=36G9EG8ZBSK5Y&,dib=eyJ2ljoiMSJ9.9%E2%80%A6&th=1 (Year: 2023).
Igloo 2-Wheeled 60 Qt Cooler, posted May 1, 2023 [online], [retrieved May 13, 2025]. Retrieved from internet, https://www.coxhardware.com/p-25333-igloo-2-wheeled-ice-chest-cooler-60-qt.aspx (Year: 2023).
Igloo Trailmate 52Qt Wheeled Cooler, posted Jan. 26, 2024 [online], [retrieved May 29, 2025]. Retrieved from internet, https://www.amazon.ca/Igloo-Trailmate-Wheeled-Cooler-Modern/dp/BOCTBSBL74/ref=sr_1_56?crid=36G9EG8ZBSK5Y&dib=eyJ2ljoiMSJ9.Xlum_xGx%E2%80%A6 (Year: 2024).
Ninja FrostVault 30qt Wheeled Cooler, posted Mar. 11, 2025 [online], [retrieved May 29, 2025]. Retrieved from internet, https://www.amazon.ca/dp/B0F1458JRL/ref=sspa_dk_detail_2?psc=1&pd_rd_=B0F1458JRL&pd_rd_w=bLvQI&content-id=amzn1.sym.516c2169-755%E2%80%A6 (Year: 2025).
Stones Boatyard_YETI Roadie 60 Wheeled Cool Box, posted Sep. 7, 2023 [online], [retrieved May 9, 2025]. Retrieved from internet, https://stonesboatyard.co.uk/products/yeti-roadie-60-wheeled-cool-box?variant=44424317796539 (Year: 2023).
Jun. 23, 2025—(WO) International Search Report & Written Opinion—PCT/US25/21992.
Aug. 11, 2025—(AU) Formalities Notice 1—App. No. 202515086.
Jul. 30, 2025—(MX) Notice of Refusal—App. No. MX/f/2024/003511.
Aug. 29, 2025—(JP) Decision of Rejection—App. No. 2024-503445.
May 14 2025—(VN) Notification of Refusal—App. 8-2024-00491.
Apr. 23, 2025—(KR) First Office Action—App. No. 30-2024-30530.
amazon.com, "YETI Roadie 60 Wheeled Cooler with Retractable Periscope Handle", YETI, retrieved on May 29, 2025 from <https://www.amazon.com/YETI-Roadie-Wheeled-Retractable-Periscope/dp/B0C8WBQHH9?adgrpid=185328981264&th=1>, 9 pages.
Apr. 2, 2025—(JP) First Office Action—App. No. 2024-017403.
amazon.co.jp, "[イエティ]Yeti クーラーボックス 19.6L ローディー24 YT65W Roadie Coolers 保冷 ハード クーラー アウトドア キャンプ レジャー 釣り [並行輸入品]", Yeti Coolers, LLC, published on Oct. 4, 2023, retrieved on Apr. 7, 2025 from <https://www.amazon.co.jp/dp/B0CKGVZ16W?th=1,> 4 pages.
Apr. 10, 2025—(JP) Notification of Refusal—App. No. 2024-503445.
Apr. 10, 2025—(JP) Notification of Refusal—App. No. 2024-503446.
May 15, 2025—(CN) First Office Action—App. No. 202430683164.3.
Dec. 5, 2025—(VN) Second Office Action—App. No 8-2024-00491.
Nov. 7, 2025—(CN) First Office Action—App No. 202530392901.9.
Feb. 24, 2026—(TH) Second Office Action—App. No. 2402003572.

* cited by examiner

INSULATING CONTAINER

BACKGROUND

Various types of containers are often used to store food or other items. In some examples, it may be advantageous to maintain a temperature of the contents being stored in the container. Accordingly, an insulating container may be used. However, certain conventional insulating containers are often not very durable and lack an adequate means to secure the lid in a closed position. For instance, they have lids that may be lost or broken, handles that may protrude from a base portion of the container, and/or ineffective latches used to secure the lid. In these examples, the lid, handle, and/or the latches may be susceptible to breakage, which, in some cases, may render the insulating container virtually useless.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Insulating containers have various features are described herein. In some examples, the insulating containers may include a base or bottom portion formed by a plurality of sides and a lid. The lid may secure an opening formed by one end of each of the plurality of sides forming the base. The opening may be configured to provide access to an interior void of the insulating container that may also be formed by a sidewall structure or plurality of sides and the bottom portion. The lid may be rotatable about a hinge or hinges from a closed position or configuration to an open configuration. The lid may also include a gasket configured to seal the opening and configured to provide a water-resistant seal when the lid is in the closed and secured configuration.

In some examples, the insulating container may include a removable strap assembly that includes: a pivot assembly having an outer pivot post located on both of the two lateral sidewalls of the base and a pivot clip attached to an end of a strap. The pivot clip may include a receptacle configured to slide over and receive the outer pivot post to connect the strap to the insulating container. The pivot clip and the strap may freely rotate from a front of the insulating container to a rear of the insulating container. The pivot clip may provide a locking mechanism for the strap when sliding the pivot clip over the outer pivot post and the pivot assembly, securely attaching the pivot clip to the pivot assembly. The pivot clip may include a base portion, a strap arm, and a transverse portion extending between the base portion and the strap arm. The strap arm may be configured to hold the end of the strap. The pivot clip may further include resilient arms spaced from the transverse portion defining a gap between the resilient arms and the transverse portion, wherein the receptacle and resilient arms have an arced shape that arcs upward from the base portion on both sides of the pivot clip. The pivot clip may include one or more stop surfaces located along the transverse portion of the pivot clip within the receptacle. The one or more stop surfaces may be configured to engage with a stop located on the pivot assembly to limit the rotation of the pivot clip relative to the pivot assembly. The stop may be located on the outer pivot post and may extend from a center top location of the outer pivot post and has a triangular shape to engage with the one or more stop surfaces on the pivot clip. The strap arm may be offset and extend from the transverse portion with one or more offset arms. The pivot assembly may include a pivot insert block located within the lateral sidewalls of the base. The pivot insert block may comprise one or more positioning slots located on a front surface of the pivot insert block. The one or more positioning slots may be configured to receive protrusions on the outer pivot post when connecting the outer pivot post to the pivot insert block. The pivot insert block may also comprise a fastener recess located in an approximate center of the pivot insert block. The fastener recess may include internal threads to engage with a fastener that extends through and connects the outer pivot post to the pivot insert block. The pivot insert block may include multiple ribs extending from a rear surface that provide stability for the pivot assembly within the base. The pivot assembly may include a pivot standoff plate that provides a bearing surface for the pivot clip and may be located between the pivot insert block and the outer pivot post. The pivot standoff plate may comprise one or more positioning slots that extend through the pivot standoff plate and are spaced and shaped to correspond to the positioning slots on the pivot insert block and the protrusions on the outer pivot post. The pivot standoff plate may also comprise a fastener hole located in an approximate center of the pivot standoff plate. The fastener hole may allow the fastener to freely slide through the pivot standoff plate to connect the outer pivot post to the pivot insert block.

In some examples, the insulating container may include a strap assembly attached to the lateral sidewalls with a strap and a handle that converts between a shoulder strap configuration and a handle configuration. The shoulder strap configuration of the strap assembly may have a first length that allows a user to carry the insulating container using the shoulder strap. The handle configuration of the strap assembly may have a second length shorter than the first length that allows the user to carry the insulating container using the handle. The strap assembly may comprise: a first pivot clip that connects to a first lateral sidewall of the base, a first slider clip, and a first strap that connects to a first side of the shoulder strap; and a second pivot clip that connects to a second lateral sidewall of the base, a second slider clip, and a second strap that connects to a second side of the shoulder strap. The first slider clip and the second slider clip may be tri-glide slider clips that provide adjustable tension and a secure hold with the strap assembly. Each of the first slider clip and the second slider clip may be rectangular-shaped with two side arms and a middle arm extending in between the two side arms forming two parallel slots. The strap assembly further may comprise one or more elastic bands located along the first strap and the second strap for constraining the first strap and the second strap near the first pivot clip and the second pivot clip.

These and various other features will be described more fully herein.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

Aspects of this disclosure relate to an insulating container configured to store contents or a volume of liquid. In some examples, the insulating container may include a strap assembly with a convertible shoulder strap and handle that can convert between a handle configuration and a shoulder strap configuration. Additionally or alternatively, the insulating container may include removable strap assembly with a clip over button interface that includes an outer pivot post and a pivot clip attached to the strap with the pivot clip sliding over the outer pivot post. Additionally or alternatively, the insulating container may include a drain assembly that is located and installed within a pass through of the wall of the insulating container. Additionally or alternatively, the insulating container may have handles that are integrally formed in the base portion of the insulating container. Additionally or alternatively, the insulating container may include a lid lockable or securable with at least one latch or at least one latching device, and the lid may be hinged to allow the lid to rotate from a closed position to an open position, and/or be non-destructively removable (e.g., able to be removed and replaced) from a base portion of the insulating container. These and various other features and aspects of the insulating container will be described more fully herein.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1A:
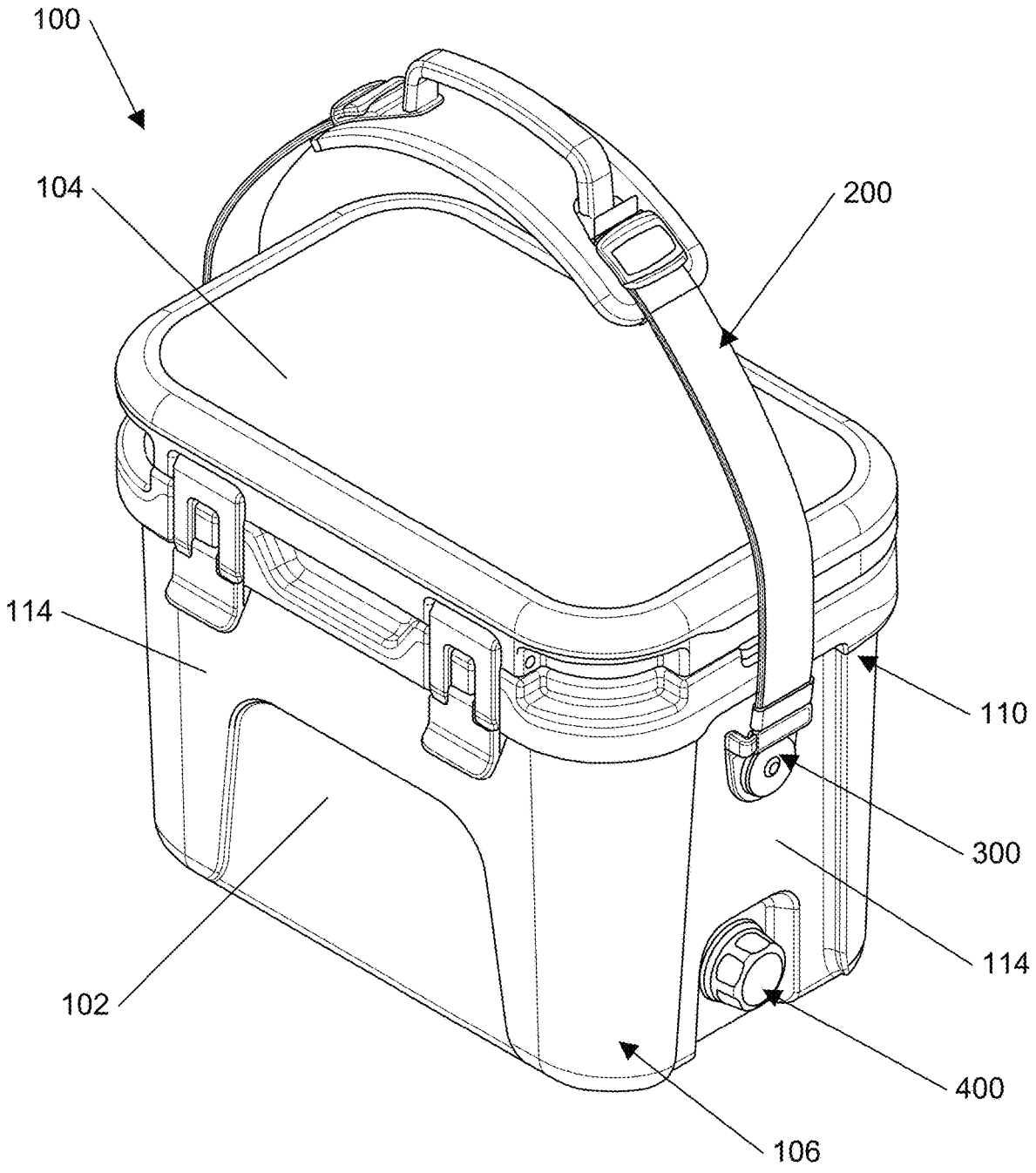
FIGS. 1A and 1B are front perspective views, respectively, of an insulating container according to one or more aspects described herein.
Figure 1B:
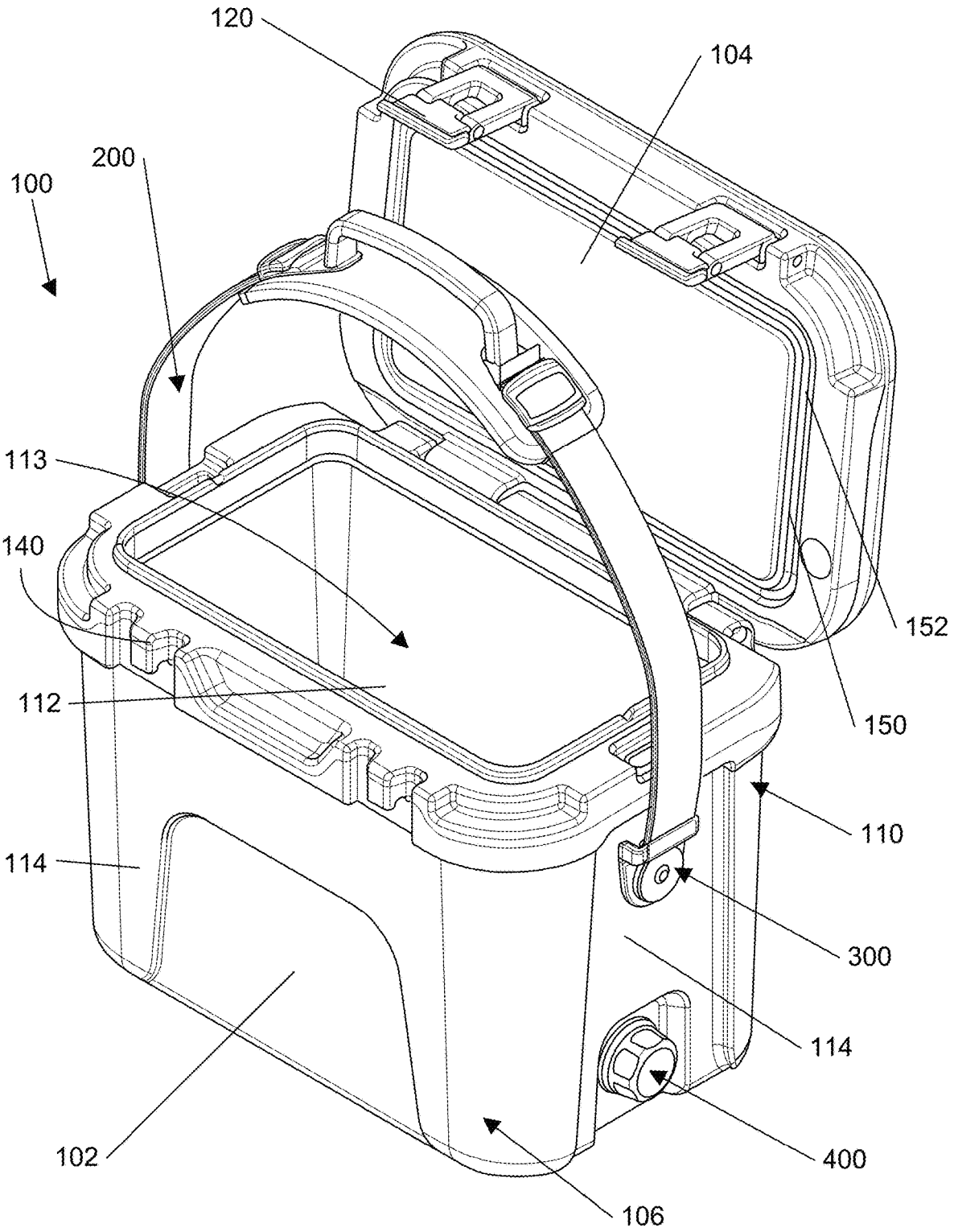

FIGS. 1A and 1B depict perspective views of an insulating container 100. In one example, the insulating container 100 may comprise a base portion 102 and a lid 104 that, in some examples, may be non-destructively, removably coupled thereto. The base portion 102 may be an insulated structure forming an interior void for containing contents or a liquid, as will be discussed more fully herein. In some examples, the base portion 102 may be cuboidal or substantially cuboidal in shape. In still other examples, the base portion 102 may be substantially cylindrical in shape or may have a substantially rectangular cross section. Various other shapes may be used without departing from the invention.

Figure 2A:
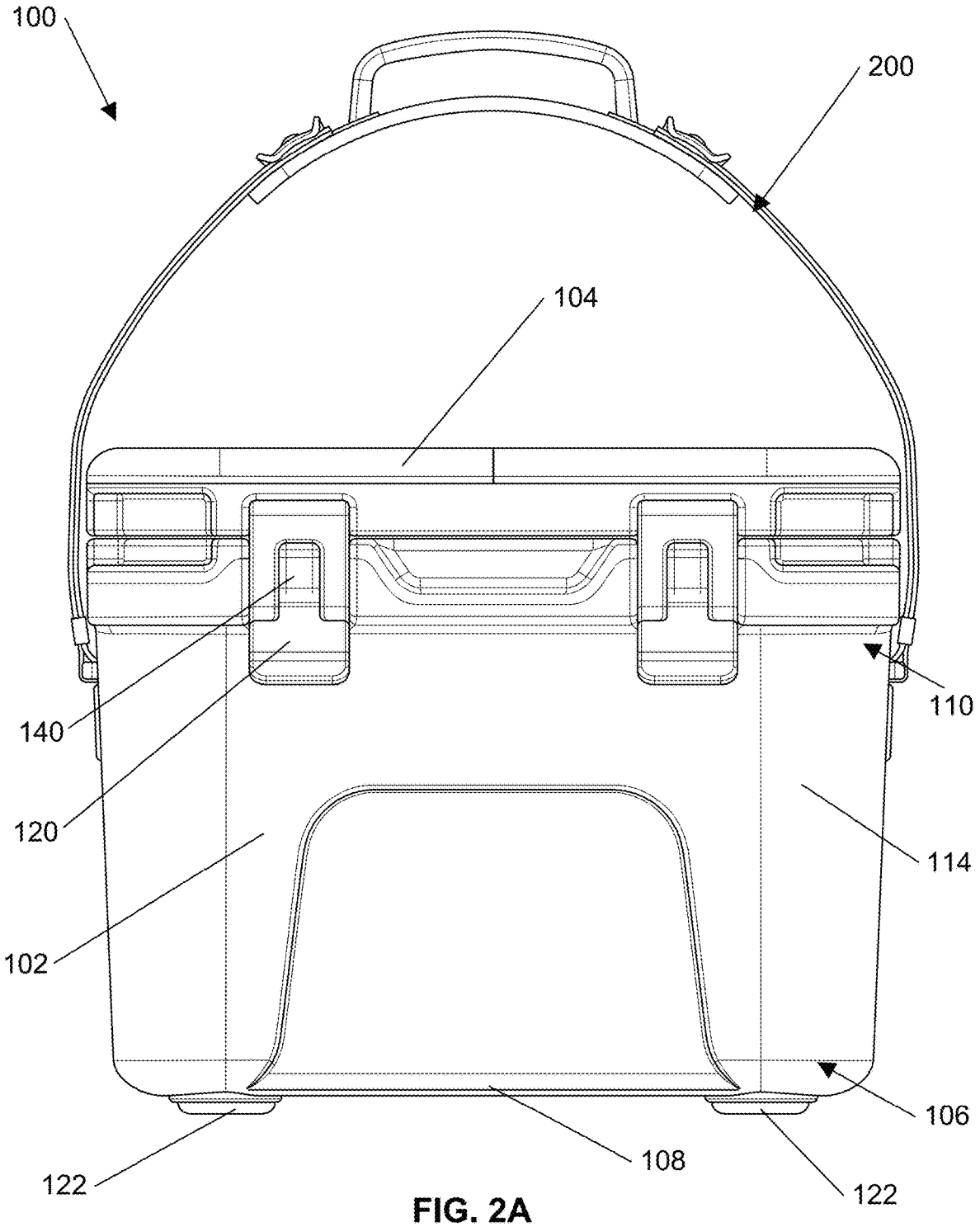
FIG. 2A is a front view of the insulating container depicted in FIG. 1A with a strap assembly and a convertible shoulder strap and handle in a handle configuration according to one or more aspects described herein.

The base portion 102 may include a first end 106, having a bottom surface 108 (shown in FIG. 2A). The bottom surface 108 may be configured to support the insulating container on a surface, such as a table, the ground, a vehicle bed, boat deck, or the like.

The base portion 102 further includes a second end 110 defining an opening 112 (shown in FIG. 1B) that may be used to access an interior void 113 of the insulating container. The opening 112 may be covered by lid 104, when the insulting container is in use (e.g., when the insulating container is in a closed configuration). The base portion 102 may further include a plurality of side portions 114 connected to the bottom surface 108 that define the interior void 113 for receiving contents in the insulating container 100. The side portions 114 may be arranged such that they extend generally perpendicularly from the bottom surface 108. The side portions 114 may include a front sidewall, a rear sidewall opposite the front sidewall, and two lateral sidewalls between the front sidewall and the rear sidewall.

Figure 3A:
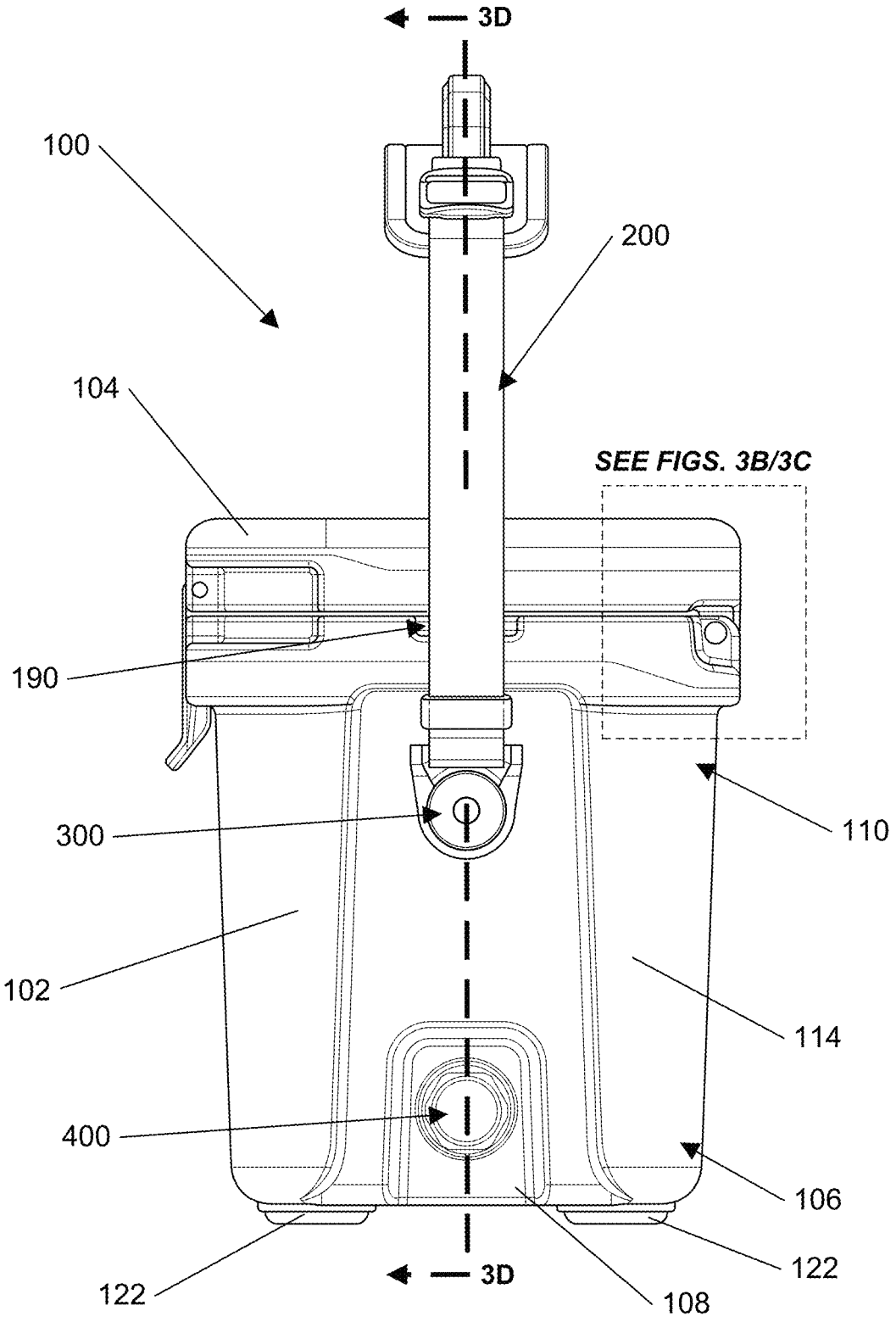
FIG. 3A is a side view of the insulating container depicted in FIG. 1A according to one or more aspects described herein.

In some examples, one or more side pocket handles 190 may be arranged in one or more side portions 114 (or other region of the base portion 102). The side pocket handles 190 may be integrally molded with the base portion 102 and may generally be an undercut or cutout formed in the side portion 114 of the base 102. In some examples, such as shown in FIG. 3A, the undercut or cutout forming the side pocket handle may include a recess extending along substantially all or a majority of the side portion 114. This may provide ease of manufacturing the base 102 with the integrally molded side pocket handles 190. In some examples, the side pocket handles 190 may be flush with an exterior surface of the base 102 in order to reduce the risk of breakage.

As discussed above, the insulating container 100 may be configured to contain, store, carry, etc., a volume of contents or possibly a liquid. In some examples, the insulating container 100 may be configured to store between twelve (12) and eighteen (18) quarts of contents. In some examples, the insulating container may be configured to store approximately fifteen (15) quarts of contents. In other examples, the insulating container may be configured to store at least twelve (12) quarts of contents, or the insulating container may be configured to store at least eighteen (18) quarts of contents, among others. In yet other examples, the insulating container may be configured to store approximately ten (10) to fourteen (14) quarts of contents, twelve (12) to sixteen (16) quarts of contents, fourteen (14) to eighteen (18) quarts of contents, sixteen (16) to twenty (20) quarts of contents, twenty (20) to twenty-four (24) quarts of contents, twenty-four (24) to thirty (30) quarts of contents, or thirty (30) to thirty-six (36) quarts of contents. In still other examples, the insulating container 100 may be configured to store between about ten (10) and about forty-thirty-six (36) quarts of contents. Additionally or alternatively, the insulating container 100 may be configured to store materials in a solid, liquid, or a gaseous state, or combinations thereof, without departing from the scope of the disclosure described herein. For example, the insulating container 100 may be sized to accommodate approximately 20-24 12-ounce cans or approximately 6-8 750 ml wine bottles.

In at least some examples, the insulating container 100 (and various other containers described herein) may be sized to accommodate the volume of contents described above. For example, the insulating container 100 may include external dimensions of at least thirteen (13) inches tall, at least sixteen (16) inches wide, and at least eleven (11) inches deep. For example, the insulating container 100 and the interior void 113 may include interior dimensions of at least ten (10) inches tall, at least thirteen (13) inches wide, and at least seven (7) inches deep. Additionally or alternatively, the insulating container 100 may be configured in different dimensions (i.e., height, width, and depth) without departing from the scope of the disclosure described herein.

As previously discussed, the insulating container 100 includes a lid 104. In some examples, the lid 104 may connect to the base 102 in a closed configuration using a press fit. FIG. 1B illustrates the lid 104 of the insulating container 100 in a substantially open position. As shown in FIG. 1A, the lid 104 is in a closed and secured position. Additionally, the lid 104 may be substantially perpendicular to the base 102 and covering the opening and not secured. In order to open the lid 104, and thereby access the interior void 113 defined by the base 102 of the insulating container 100, the lid 104 may be lifted upward. When the lid 104 is configured in the closed and secured position, the lid seals the opening 112. The lid may be configured to travel approximately 115° from the fully closed to fully open position. In some examples, the lid is configured to travel at least 90°, 95°, 100°, 105°, 110°, 115°, or 120° from the fully closed to fully open position. In other examples, the lid 104 may be configured to travel from about 90° to 120° in the fully open position. In some examples, the lid remains upright when configured in the fully upright position. In still other examples, to open the lid 104 (e.g., to allow access to an interior void 113 formed by the base 102), the hinged lid 104 may be rotated away from the base portion 102 and may rest along a rear side of the base portion 102 (e.g., the lid may rotate at least 90° from a closed configuration (e.g., the position shown in FIGS. 1A, 2A, 2B, 3A, and 3D) to an open configuration (e.g., the position shown in FIG. 1B). In some examples the fully open position or configuration may include at least a portion of a top, exterior surface of the lid 104 being in contact with a rear (or other) side portion 114 of the base portion 102 of the insulating container 100.

Figure 3B:
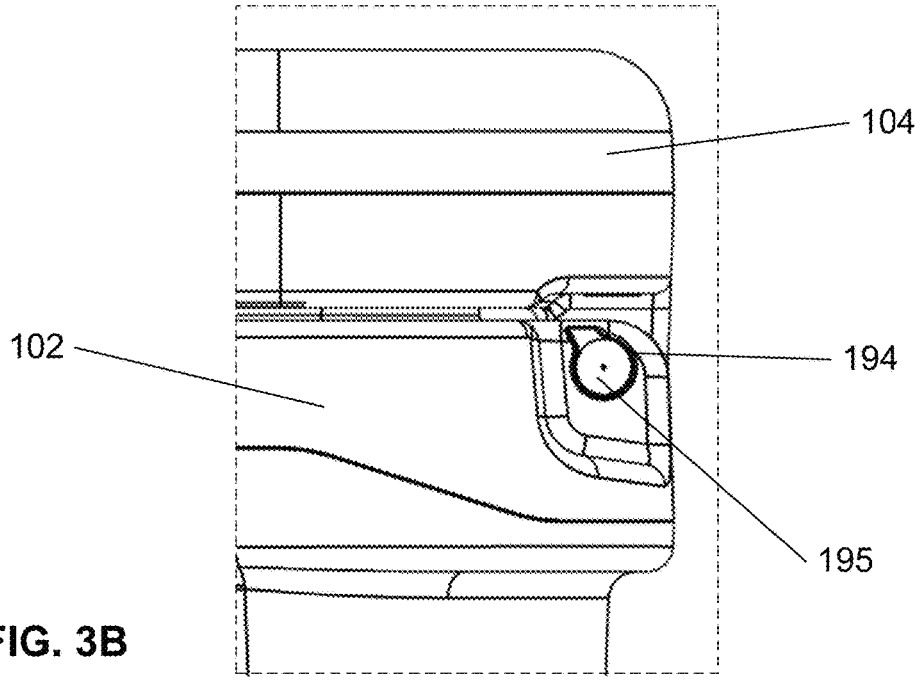
FIG. 3B is a close-up view from FIG. 3A of a corner of the insulating container depicted in FIG. 1A showing a hinge between a lid and a base according to one or more aspects described herein.
Figure 3C:
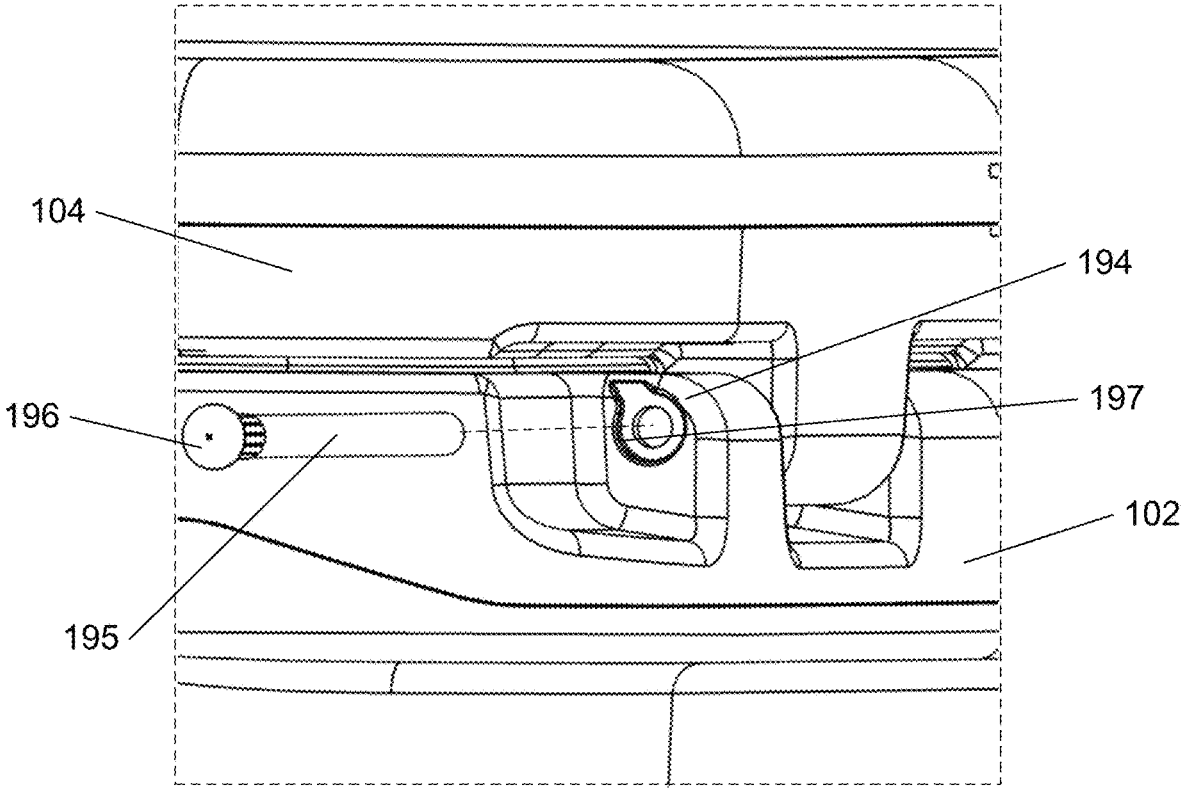
FIG. 3C is a perspective view from FIG. 3B showing a hinge pin removed from the hinge according to one or more aspects described herein.
Figure 4:
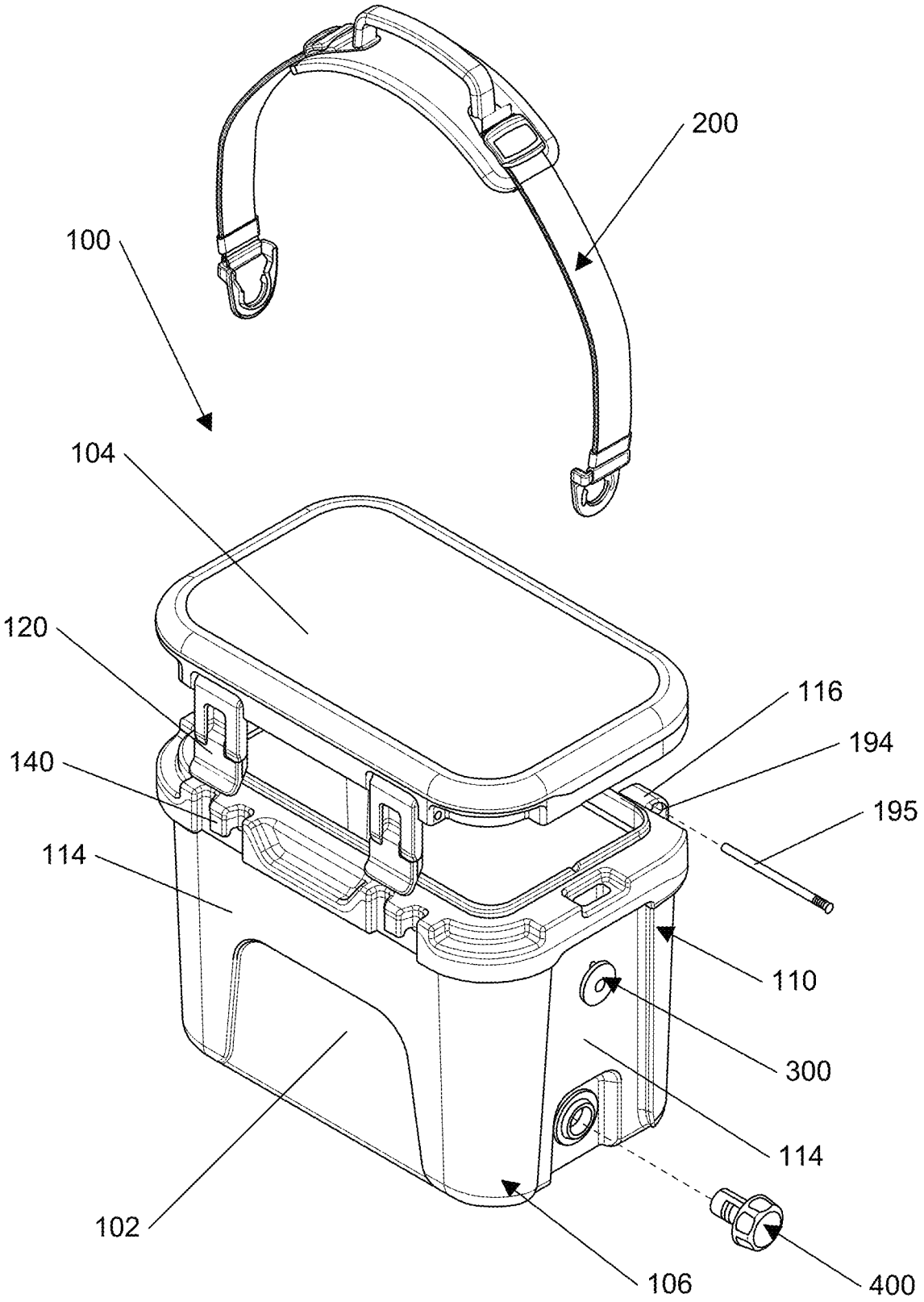
FIG. 4 is a perspective exploded component view of the insulating container depicted in FIG. 1A according to one or more aspects described herein.

In some examples, the lid 104 may be hinged such that it is connected to (either removably or permanently) the base 102 at a hinge 116 and may be rotated about the hinge 116. The hinge may be one of various types of hinges, including a continuous piano hinge, double hinge, ball joint hinge, living hinge, and the like. The hinge 116 may permit the lid 104 to be opened and rotated away from the base portion 102, to allow access to the interior void 113 defined by the base portion 102 (e.g., via opening 112). That is, the hinge 116 may facilitate rotation of the lid 104 from a closed configuration of the insulating container (e.g., when the lid is in place covering the internal void formed by the base) to an open configuration (e.g., when the lid is not covering the internal void formed by the base), and vice versa. In some examples, the insulating container 100 is configured with at least one hinge 116. In another example, the insulating container is configured with a plurality of hinges. In still other configurations, hinge 116 comprises a first portion integrally molded in the lid 104 and a second portion integrally molded in the base 102. In yet other examples, as illustrated in FIGS. 3B, 3C, and 4, the hinge 116 may further include at least one pin pocket 194 or a plurality of pin pockets 194 to secure the lid 104 to the base 102 via at least one hinge pin 195 thus allowing the lid 104 to rotate from a closed position to an open position. In other examples, a plurality of hinge pins 195 secure the lid 104 to the base 102. As illustrated in FIG. 3C, the pin pocket 194 may include a geometry that allows a pin head 196 on the hinge pin 195 to be sub-flush, such that the hinge pin 195 is more difficult to remove when the lid 104 is closed and secured. The pin pocket 194 may include an inset portion 197 sized and shaped for the pin head 196 of the hinge pin 195 to set sub-flush when fully inserted into the pin pocket 194.

Figure 3D:
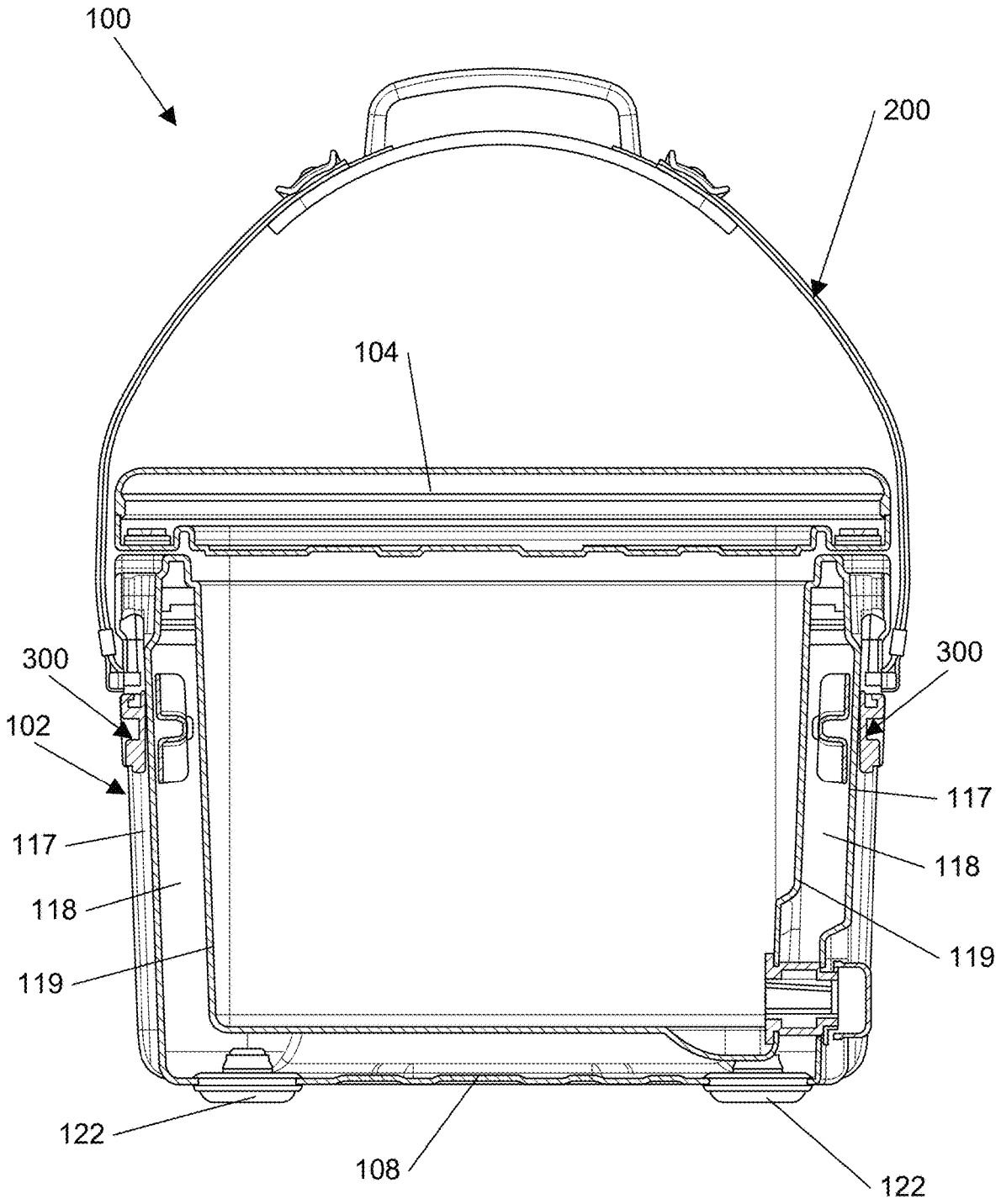
FIG. 3D is a cross-sectional view of the insulating container of FIG. 3A taken along line 3D-3D according to one or more aspects described herein.

In the examples described herein, base 102 and lid 104 may include an exterior surface or outer shell 117 surrounding and enclosing an insulating portion 118 that surrounds and encloses an inner shell 119, as shown in FIG. 3D. The outer shell 117 and inner shell 119 may be typically formed from various materials, such as one or more metals, alloys, polymers, ceramics, or fiber-reinforced materials. In some examples, the outer shell 117 and inner shell 119 may be formed of a plastic material, such as polyethylene, that is molded to form both the base 102 and lid 104 portions. In some examples, the insulating portion 118 is formed of an insulating material that exhibits low thermal conductivity. For instance, the insulating portion 118 may be formed of (or filled with) a polymer foam, such as polyurethane foam. Additional or other insulating materials may be used without departing from the invention. In some examples, the base 102 and lid 104 portions are formed using a roto-molded process as would be understood by one of ordinary skill in the art (not shown). However, various other types of molding or other manufacturing processes (e.g., stamping, casting, forging, and the like) may be used to form the insulating container 100 without departing from the invention.

Figure 5B:
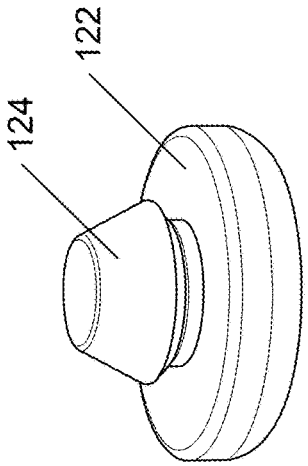
FIGS. 5B and 5C are top and bottom perspective views, respectively, of the base foot depicted in FIG. 5A according to one or more aspects described herein.
Figure 5C:
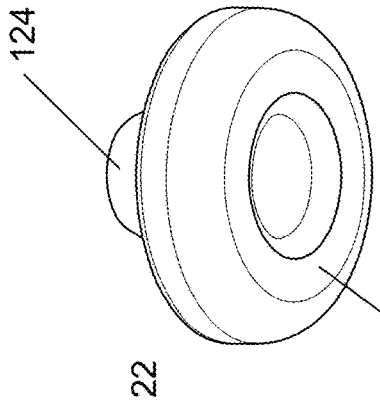
Figure 5A:
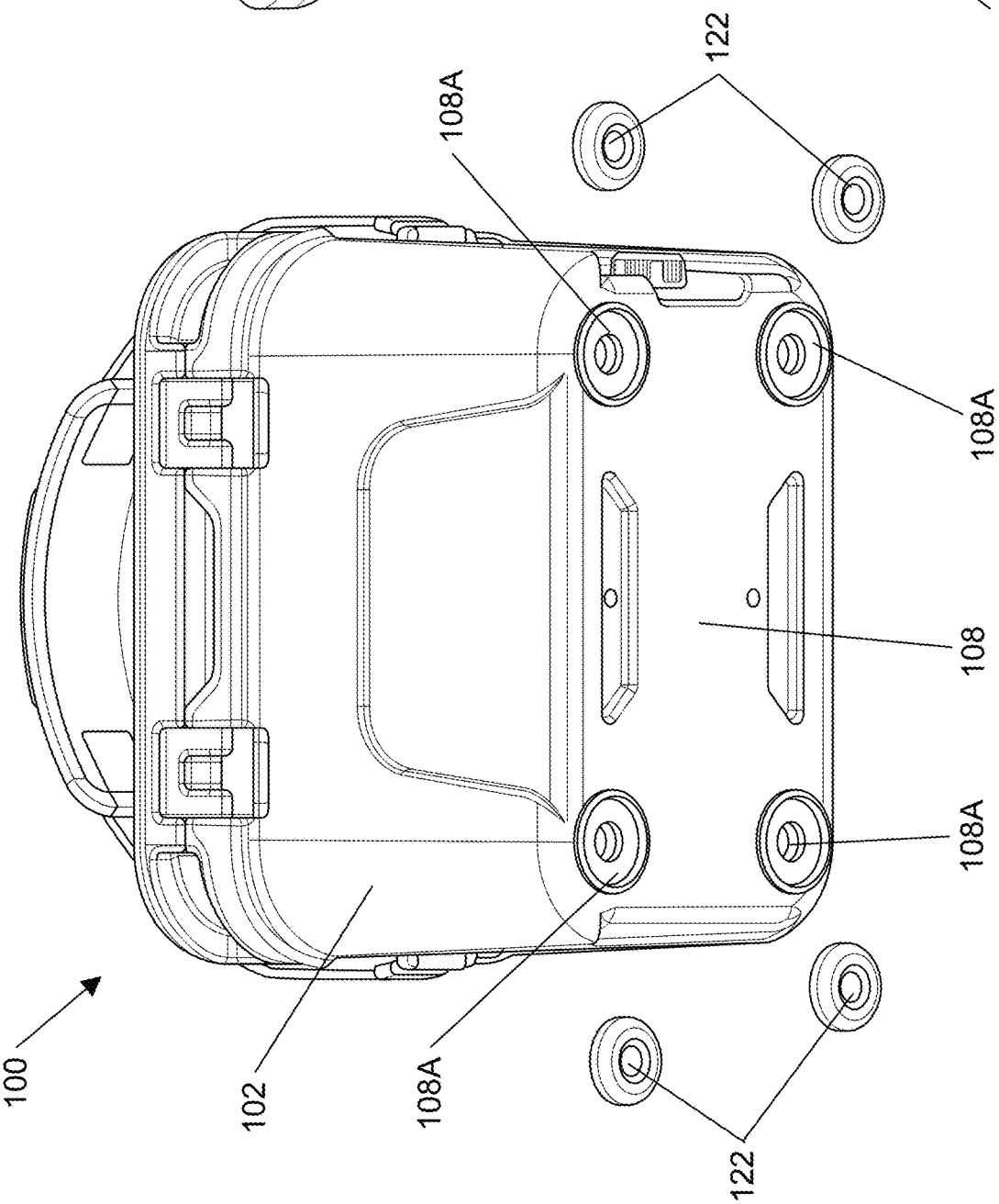
FIG. 5A is a bottom perspective component view of the insulating container depicted in FIG. 1A with the base feet removed according to one or more aspects described herein.

The base portion 102 may include a first end 106, having a bottom surface 108. The bottom surface 108 may be configured to support the insulating container on a surface, such as a table, the ground, a vehicle bed, boat deck, or the like and may include a plurality of feet 122, as shown in FIGS. 5A-5C. Feet 122 may be configured to provide a non-skid or no-slip surface, and may be configured to keep the insulating container 100 elevated off the ground. In another example, feet 122 may be non-slip feet and configured to reduce friction with the ground or surface so that the insulating container may be moved more easily while the container is on the ground (i.e., the insulating container may easily slide or be easily pushed across the ground). Feet 122 may be constructed of rubber, foam, plastic, or other suitable material. The feet 122 may include threaded or compression inserts 124 that extend into recessed pockets 108A within the bottom surface 108. The recessed pockets 108A and feet 122 may enable mounting solutions for the insulating container 100. In still other embodiments, the bottom surface 108 may include a logo or name of a company or manufacturer of the insulating container embossed, integrally molded, or pressed into the outer shell 117.

In addition, in some examples, the insulating container 100 may include a gasket 150 or other sealing device (as shown in FIG. 1B). The gasket 150 may be arranged in either the lid 104 or the base 102 and may aid in sealing the lid 104 and the base 102 when the lid 104 is in a closed and secured configuration. In other examples, the gasket 150 may be arranged in either the lid 104 or the base 102 and may provide a watertight or water-resistant seal when the lid 104 is in a closed and secured configuration. In some examples, the gasket may be seated in a recess formed in at least one of the base 102 and the lid 104 and extending around a perimeter of the at least one of the base 102 or the lid 104. In other examples, as shown in FIG. 1B, the gasket 150 may be seated in a gasket adapter 152 formed in at least one of the base 102 or the lid 104 and extending around a perimeter of the at least one of the base 102 or the lid 104. In other examples, the gasket 150 may be constructed of rubber, silicone, or other suitable material. The gasket 150 may aid in maintaining the temperature of the contents or liquid contained within the insulating container 100. Various other gasket examples may be used with any of the insulating containers 100 described herein.

In some examples, the gasket 150 may include strategically placed cut-outs that may reduce or eliminate a need for a vent (e.g., a vent to prevent lid lock). In some examples, the gasket 150 may be a traditional gasket having a substantially circular cross section. In other examples, the gasket 150 may have a particular cross section configured to aid in venting the insulating container 100. In some examples, the cross section is a V-shaped or substantially V-shaped portion of the gasket. In yet other examples, the gasket 150 may also include at least one weep hole to allow passive venting of air or fluids in and out of the interior void 113 when the insulating container 100 is in a closed and secured configuration to prevent lid lock. In other examples, the gasket 150 may include a plurality of weep holes. In still other examples, the gasket 150 is configured to provide a watertight or water-resistant seal when the lid 104 is in a closed and secured configuration.

The insulating container 100 and the base portion 102 may also include a strap assembly 200 that connects to a pivot assembly 300 located on the base portion 102. The removable strap assembly 200 may include a clip over button interface that includes an outer pivot post 350 (shown in FIGS. 6A-6F) and a pivot clip 210 (shown in FIGS. 7A-7D) attached to a strap 230 (shown in FIGS. 8A-8C) with the pivot clip 210 sliding over the outer pivot post 350. The clip over button interface may be defined by the one or more pivot assemblies 300 located on the lateral sidewalls of the base 102 and the pivot clip 210. Each end of the strap assembly 200 may be attached to a pivot assembly 300 allowing the strap assembly 200 to freely rotate from the front of the insulating container 100 to the rear of the insulating container 100.

Figure 2B:
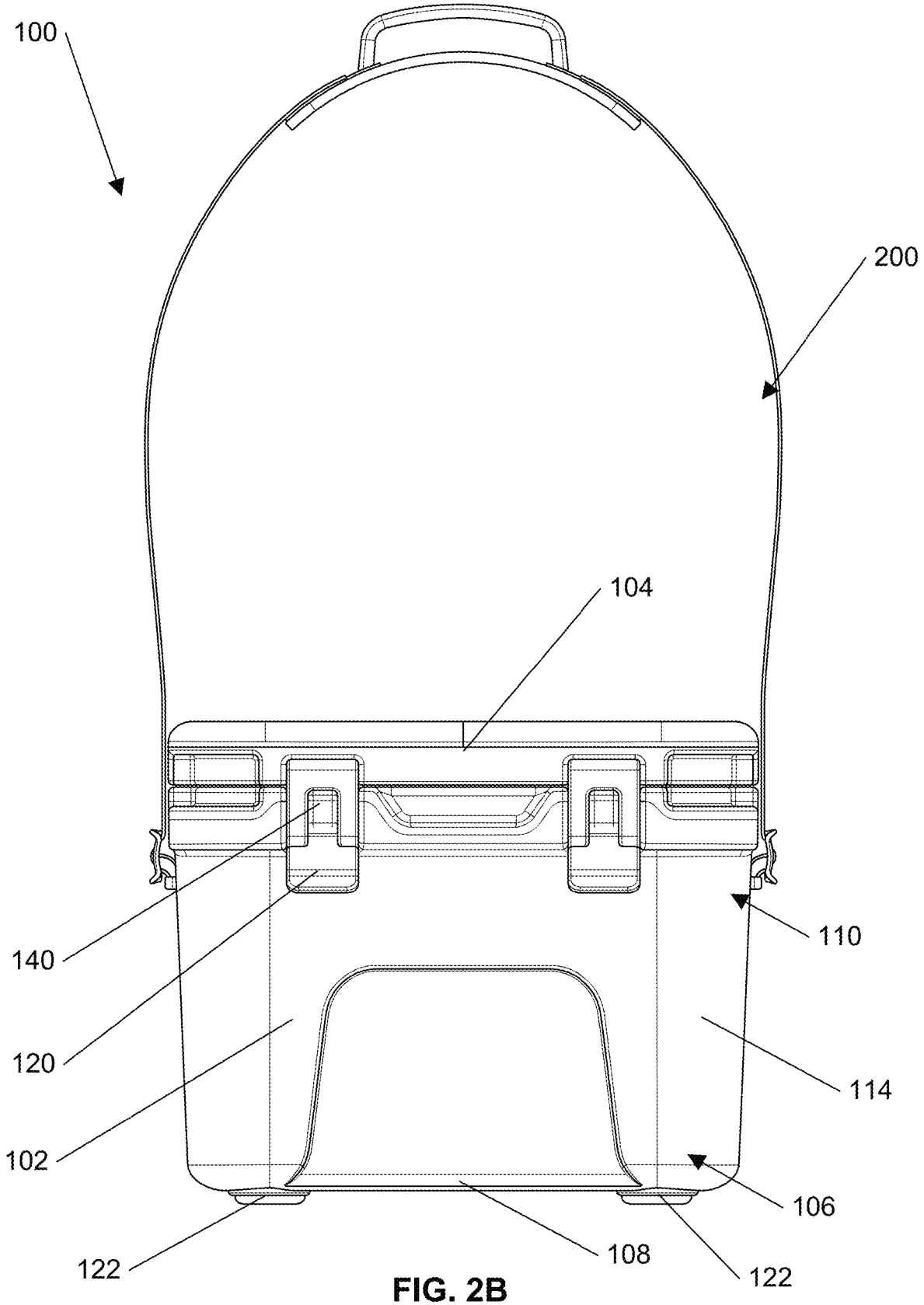
FIG. 2B is a front view of the insulating container depicted in FIG. 1A with the strap assembly and the convertible shoulder strap and handle in a shoulder strap configuration according to one or more aspects described herein.
Figure 8A:
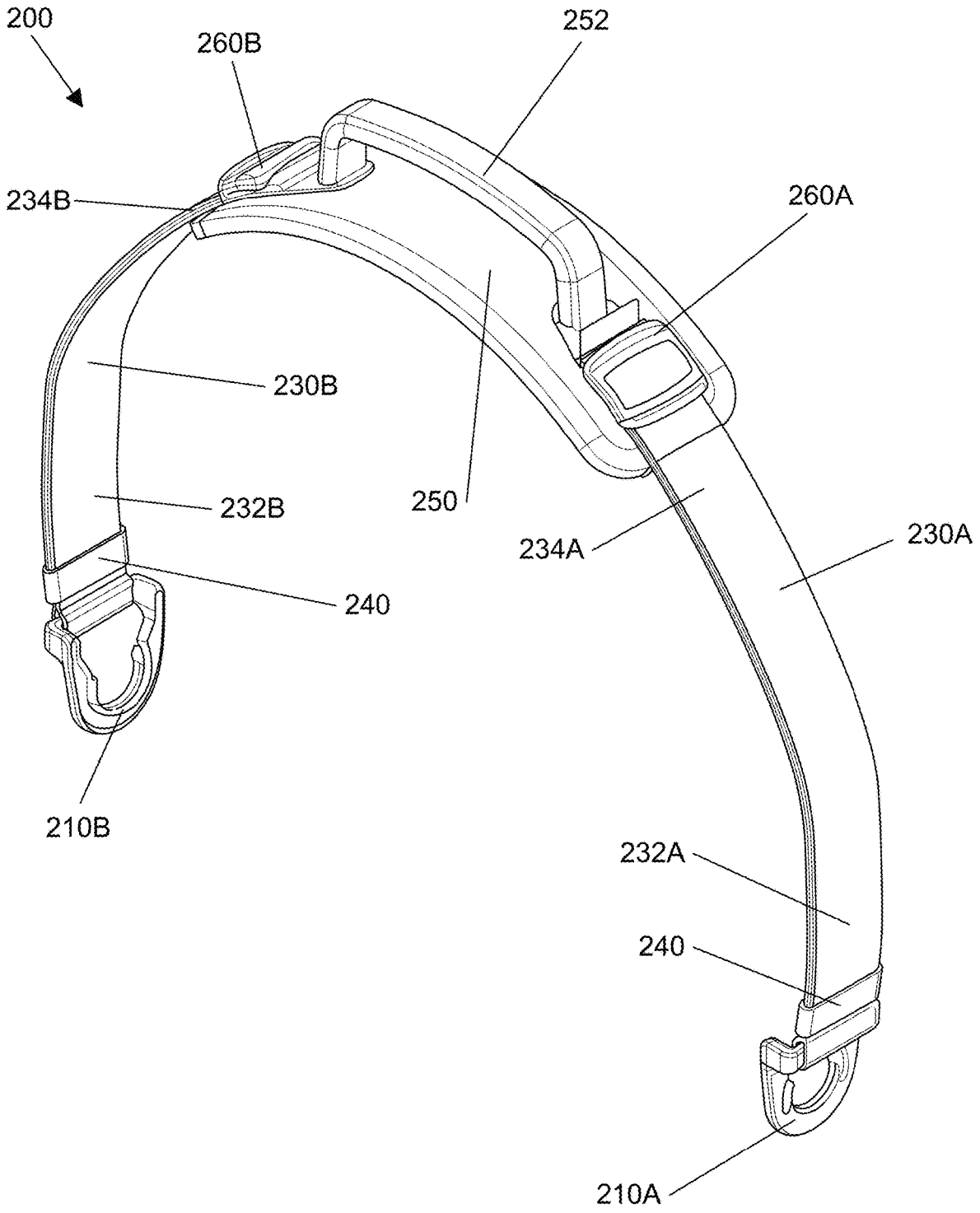
FIG. 8A is a front perspective view of the strap assembly from the insulating container depicted in FIG. 1A according to one or more aspects described herein.
Figure 8B:
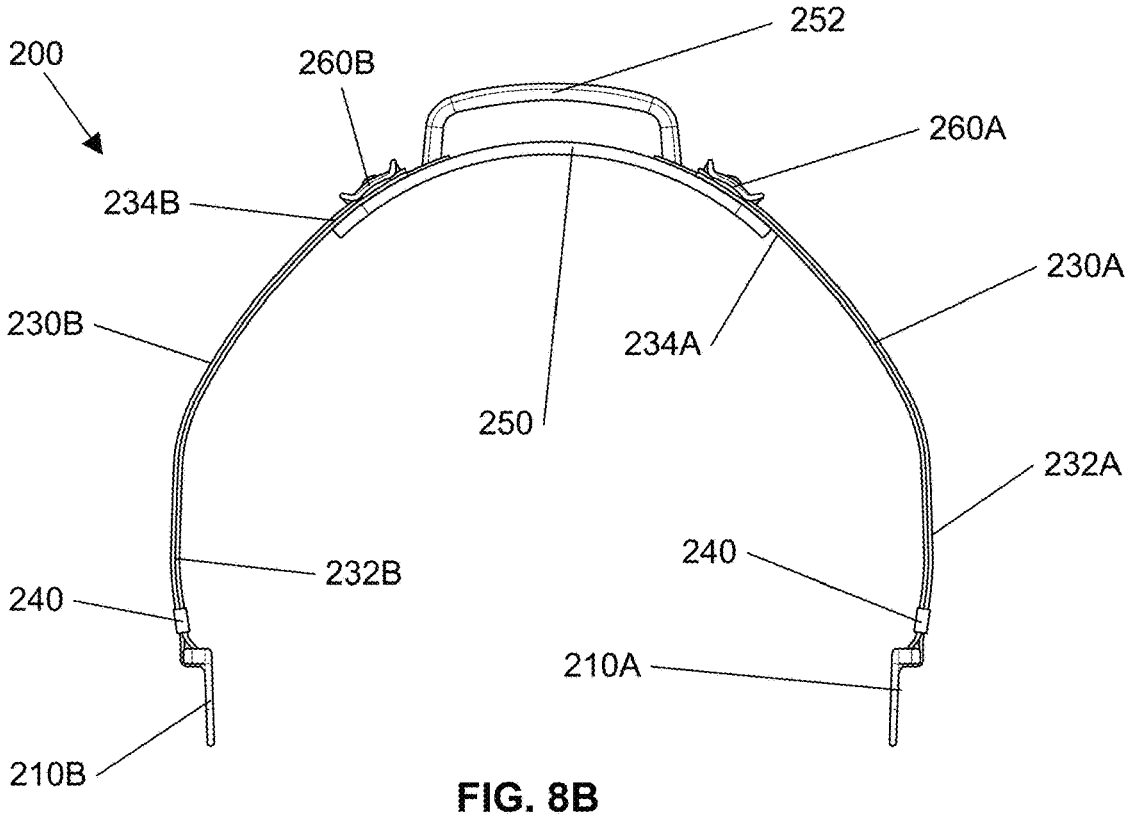
FIG. 8B is a front view of the strap assembly depicted in FIG. 8A according to one or more aspects described herein.
Figure 8C:
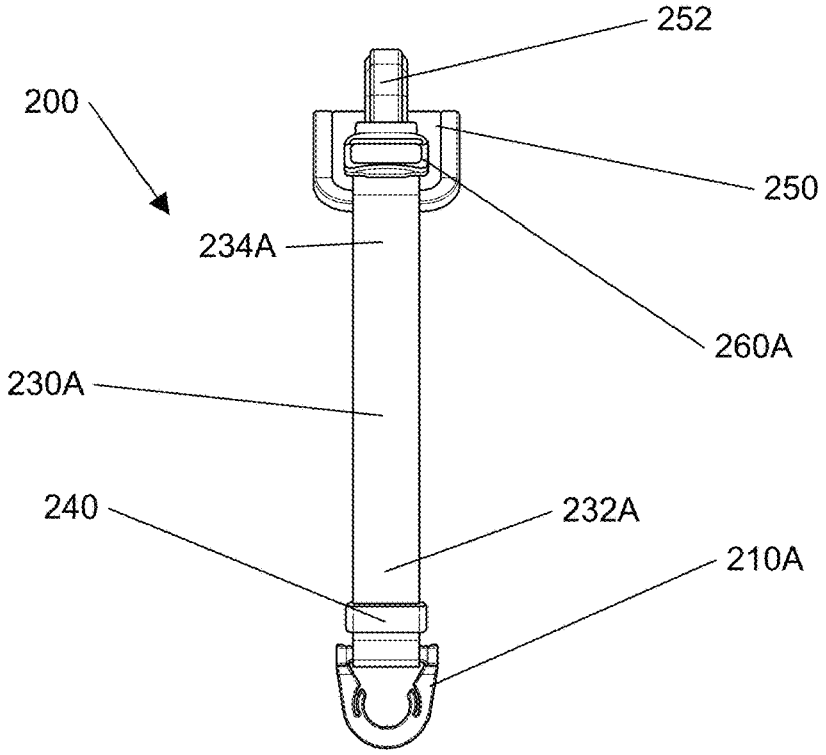
FIG. 8C is a side view of the strap assembly depicted in FIG. 8A according to one or more aspects described herein.

As shown in FIGS. 8A-8C, the strap assembly 200 may include one or more straps 230A, 230B with a pivot clip 210A, 210B and a slider clip 260A, 260B attached to a shoulder strap 250 with a handle 252. The shoulder strap 250 may include padding or cushioning to provide comfort to the user and the shoulder. The strap assembly 200 may include a convertible shoulder strap 230 with a handle 252 that can convert between a handle configuration and a shoulder strap configuration. The handle configuration is depicted in FIG. 2A showing the strap assembly 200 in the shortened length. In the handle configuration, the user can carry the insulating container 100 using the handle 252. The shoulder strap configuration is depicted in FIG. 2B showing the strap assembly 200 extended to full length. In the shoulder strap configuration, the user can carry the insulating container 100 using the shoulder strap 250.

The strap assembly 200 may include a first pivot clip 210A, a first strap 230A, and a first slider clip 260A that connects to one side of the insulating container 100 and a first side 254A of the shoulder strap 250. The strap assembly 200 may also include a second pivot clip 210B, a second strap 230B, and a second slider clip 260B that connects to the opposite side of the insulating container 100 and a second side 254B of the shoulder strap 250. The strap assembly 200 may also include one or more elastic bands 240 located along the straps 230A, 230B for constraining the straps 230A, 230B near the pivot clips 210A, 210B.

FIGS. 9A-9D depict various views of a pivot clip 210, which represents either of pivot clips 210A, 210B shown in FIGS. 8A-8C. As illustrated in FIGS. 9A-9D, the pivot clip 210 may include a base portion 212, a transverse portion 214, and a strap arm 216. The transverse portion 214 may extend between the base portion 212 and the strap arm 216. The strap arm 216 may be offset and extend from the transverse portion 214 with one or more offset arms 218. In some examples, the strap arm 216 may be offset approximately ½ inch (13 mm) from the plane of the base portion 212 of the pivot clip 210 to help enable pivoting and rotation of the strap assembly 200. In other examples, the strap arm 216 may be offset between approximately ¼ inch (6 mm) to ¾ inch (19 mm) from the plane of the base portion 212 of the pivot clip 210. In yet other examples, the strap arm 216 may be offset as much as approximately 1.5 inches (38 mm) from the plane of the base portion 212 of the pivot clip 210. The strap arm 216 may be configured to allow attachment of the strap 230A, 230B to the pivot clip 210A, 210B.

Additionally, the pivot clip 210 may include a receptacle 220 defined within the base portion 212. The receptacle 220 may be configured to slide over and receive a portion of the pivot assembly 300 to connect the strap assembly 200 to the insulating container 100. The receptacle 220 may be in the form of an aperture in one embodiment, but may be formed as a partially-open notch or other suitable structure in other embodiments. Each pivot clip 210 may include a base portion 212 with a receptacle 220 defined therein, with the base portion 212 including resilient arms 222 being spaced from the transverse portions 214 to define a gap 224 between the resilient arms 222 and the transverse portion 214. The receptacle 220 and resilient arms 222 in the embodiment of FIGS. 9A-9D may have an arched shape that arcs upward from the base portion 212 on both sides of the pivot clip 210. In this configuration, the gap 224 extends continuously between the transverse portion 214 and the resilient arms 222. The resilient arms 222 from the pivot clip 210 help to provide a locking mechanism when sliding the pivot clip 210 over the pivot assembly 300, securely attaching the pivot clip 210 to the pivot assembly 300. The resilient arms 222 may provide a biasing force for the pivot clip 210 against the pivot assembly 300 to create the locking mechanism when sliding the pivot clip 210 over the pivot assembly 300.

Figure 9A:
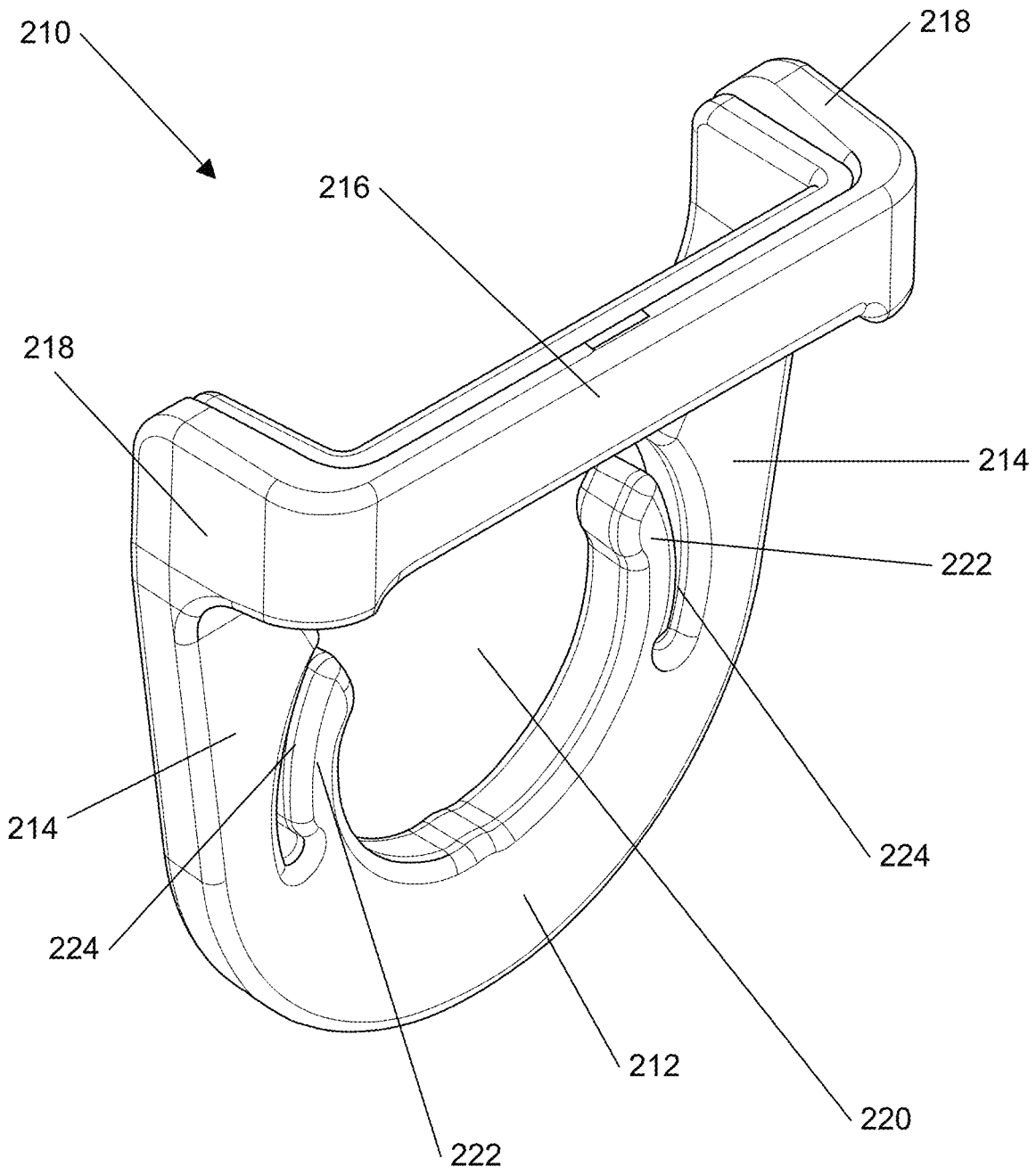
FIG. 9A is a front perspective view of the pivot clip from the strap assembly depicted in FIG. 8A according to one or more aspects described herein.
Figure 9B:
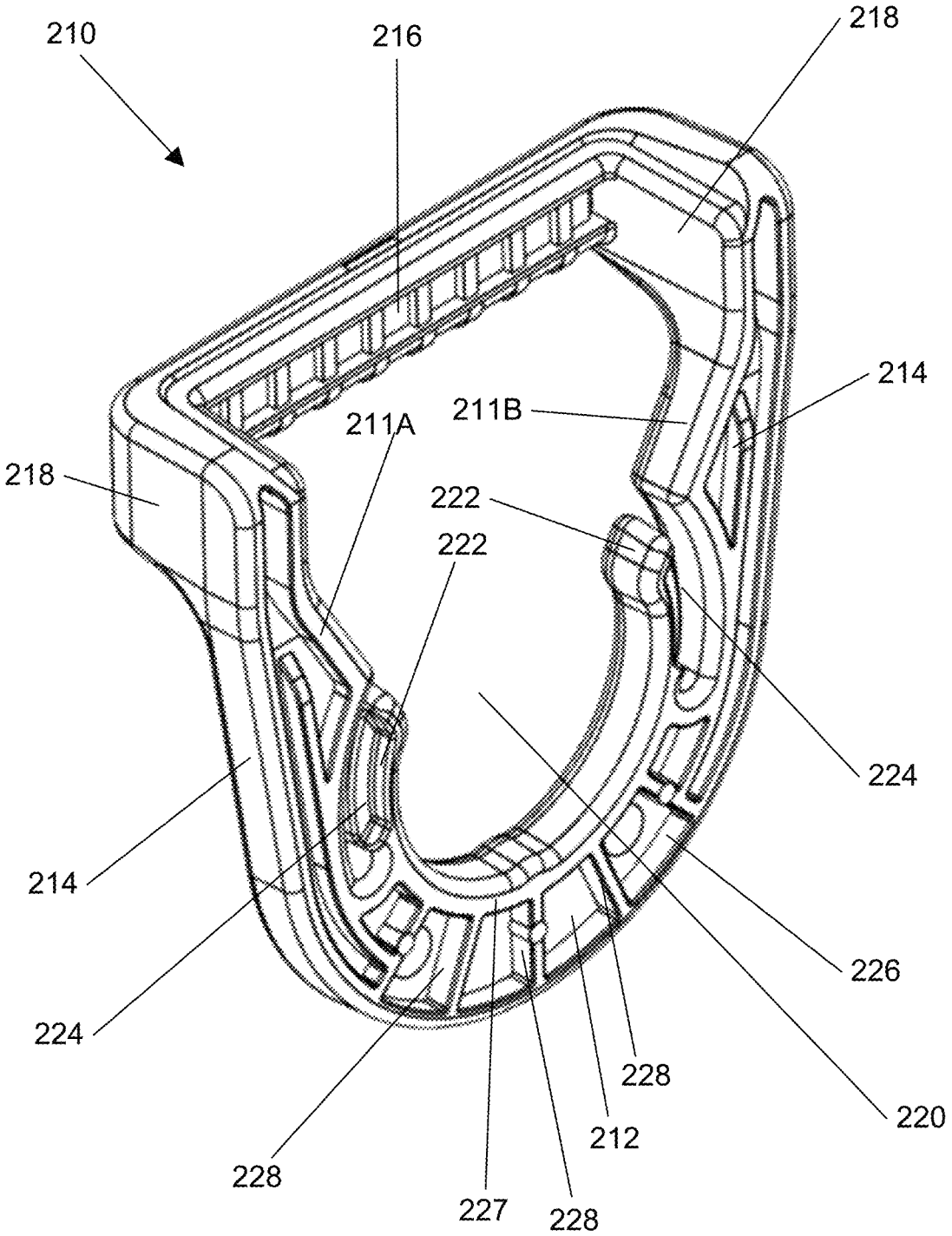
FIG. 9B is a rear perspective view of the pivot clip depicted in FIG. 9A according to one or more aspects described herein.
Figure 9C:
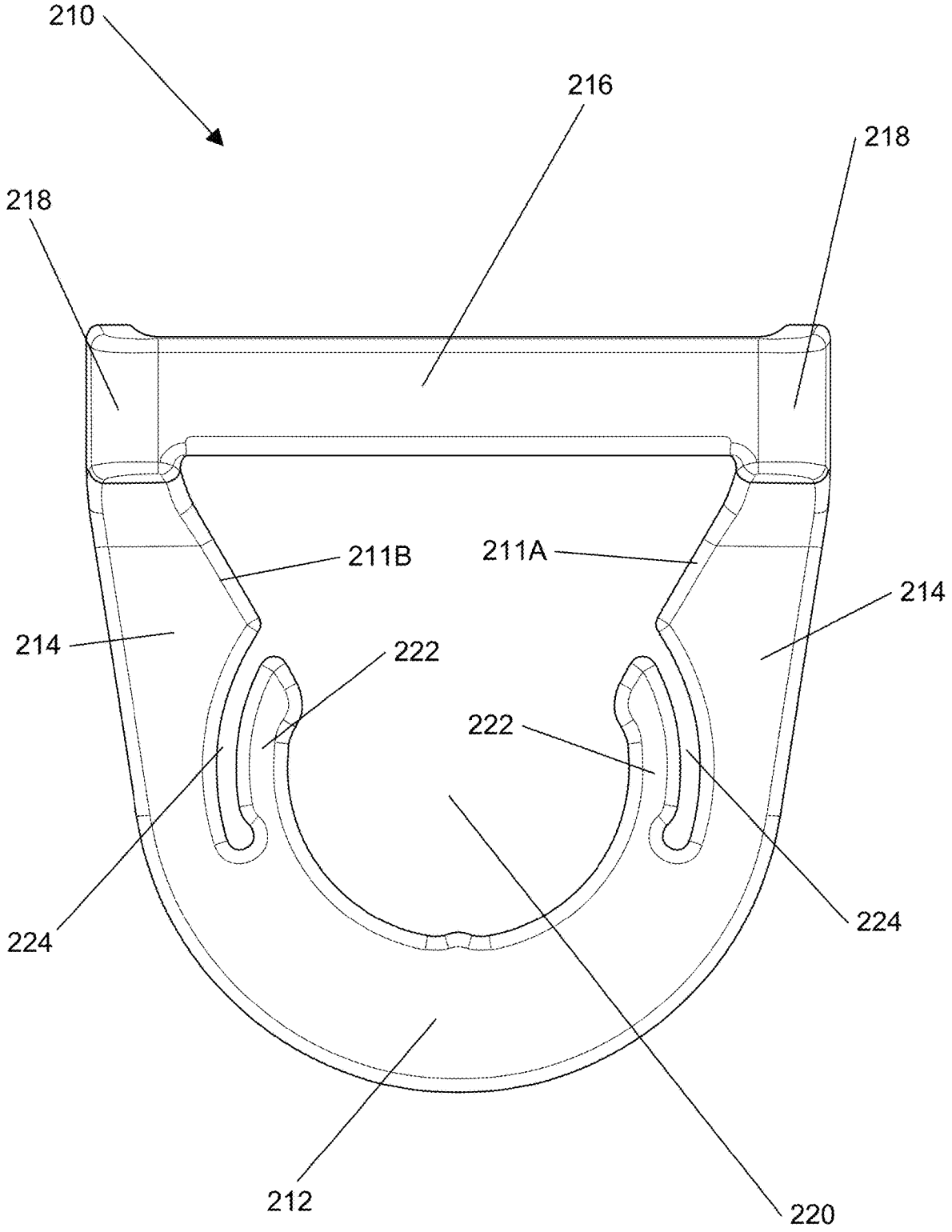
FIG. 9C is a front view of the pivot clip depicted in FIG. 9A according to one or more aspects described herein.
Figure 9D:
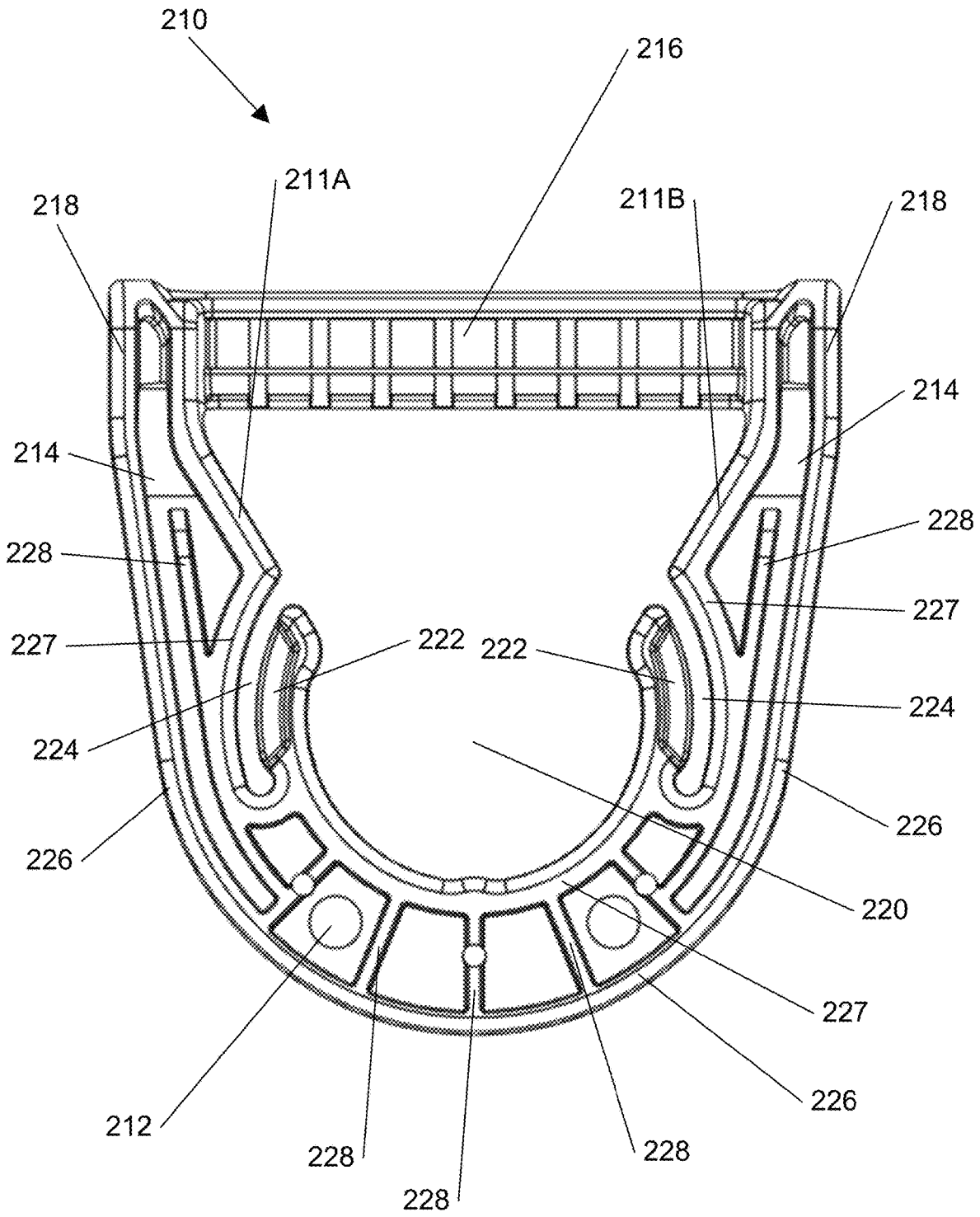
FIG. 9D is a rear view of the pivot clip depicted in FIG. 9A according to one or more aspects described herein.
Figure 10A:
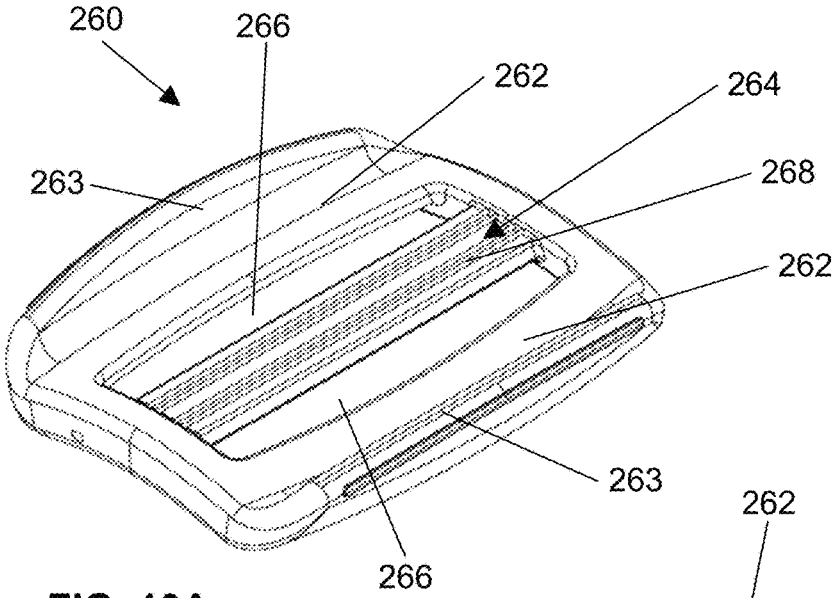
FIG. 10A is a front perspective view of the slider clip from the strap assembly depicted in FIG. 8A according to one or more aspects described herein.
Figure 10C:
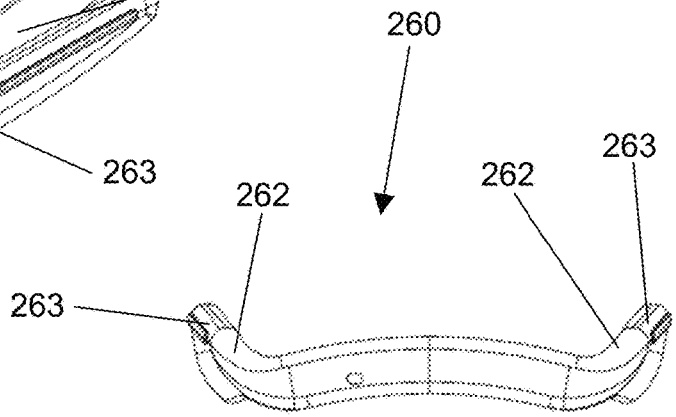
FIG. 10C is a side view of the slider clip depicted in FIG. 10A according to one or more aspects described herein.
Figure 10B:
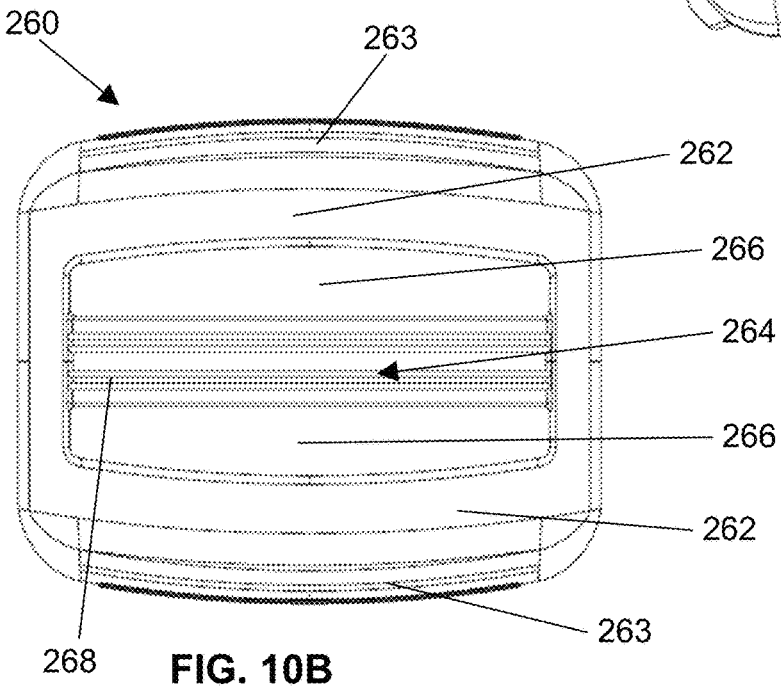
FIG. 10B is a top view of the slider clip depicted in FIG. 10A according to one or more aspects described herein.
Figure 10D:
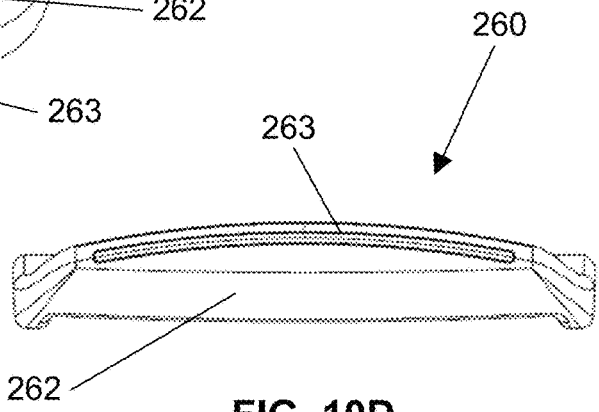
FIG. 10D is a side view of the slider clip depicted in FIG. 10A according to one or more aspects described herein.

FIGS. 9B and 9D depict rear views of the pivot clip 210. As illustrated in FIGS. 9B and 9D, the pivot clip 210 may be formed with an outer wall 226, an inner wall 227, and one or more support ribs 228. The outer wall 226, inner wall 227, and one or more support ribs 228 may provide structure support and integrity for the pivot clip 210. Additionally, as depicted in FIGS. 9B and 9D, the pivot clip 210 may include one or more stop surfaces 211 located along the transverse portion 214 of the pivot clip 210 within the receptacle 220. The one or more stop surfaces 211 may be configured to engage with the one or more stops 358 on the pivot assembly 300. The rotation of the strap assembly 200 may be limited by the engagement of the one or more stops 358 with one or more stop surfaces 211 on the pivot clip 210 when the strap assembly 200 is rotated from the front and the back of the container 100.

FIGS. 10A-10D depict various views of a slider clip 260, which represents either of slider clips 260A, 260B shown in FIGS. 8A-8D. The slider clip 260 may be in the form of a tri-glide slider clip, which might be referred to as tri-glides, strap adjuster, webbing adjuster, webbing glide, or webbing slide. As illustrated in FIGS. 10A-10D, the slider clip 260 may include two or more side arms 262 and one or more middle arms 264 in the middle of the side arms 262. The slider clip 260 may be in the form of a rectangle with two side arms 262 on both sides of the slider clip 260 and a middle arm 264 in the middle of the two side arms 262, thus defining and creating two separate slots 266. The sides arms 262 and the middle arm 264 may be parallel with each other thereby creating the parallel slots 266. The side arms 262 and the middle arm 264 may include teeth or ridges 268 that engage with the strap 230, allowing for precise adjustment and a secure hold. Each of the side arms 262 may include an angled edge portion 263 that is configured to assist with sliding the strap 230 through the slots 266 on the slider clip 260. The slider clip 260 may allow for and provide adjustable tension and a secure hold. The slider clip 260 may provide easy adjustment by sliding the strap 230 through the slots 266, and once in place the slider clip 260 prevents the strap 230 from slipping or loosening.

Other strapping alternatives to the tri-glide slider clip 260 as depicted in FIGS. 10A-10D may be utilized without departing from these embodiments. In other examples, the slider clip 260 may be other strapping and locking alternatives known and used in the art, such as cord locks, ladder locks, cam buckles, D-rings, loops, side release buckles, snap hooks, strap adjusters, snaps, swivel snaps, loops and sliders, or buckles.

As depicted in FIGS. 8A-8C, the straps 230A, 230B may include a first end 232A, 232B and an opposing second end 234A, 234B opposite the first end 232A, 232B. The first end 232A, 232B of the straps 230A, 230B may be connected to and/or looped about a strap arm 216 of the pivot clips 210A, 210B and coupled to itself with the slider clip 260. Stitching may be utilized to keep the slider clip 260 from slipping off the strap 230A, 230B. The second end 234A, 234B of the straps 230A, 230B may be looped and coupled to itself with stitching to form a loop. The second end 234A, 234B of the straps 230A, 230B slips within loop and the first end 232A, 232B may be pulled to adjust the length of straps 230A, 230B to lengthen or shorten the straps 230A, 230B from the strap assembly 200. The second end 234A, 234B of the straps 230A, 230B may be connected and/or secured through the slider clips 260A, 260B and to the shoulder strap 250.

As shown in FIGS. 1A-3D, the strap assembly 200 and the pivot clip 210 engage the pivot assembly 300. The pivot clip 210 may be configured to rotate approximately 100° (50° from vertical to both the front and the back of the insulating container 100). In another example, the pivot clip 210 may be configured to rotate approximately as much as 240° and allows the strap assembly 200 to be rotated from the front of insulating container 100 to the rear of the insulating container 100. In another example, the strap assembly 200 and the pivot clip 210 engage the pivot assembly 300 and is configured to travel in an arc over the lid 104. In other examples, the pivot clip 210 is configured to travel at least 80°, 90°, 100°, 120°, 160°, 200°, or 240°. In other examples, the pivot clip 210 is configured to travel from about 80° to 120° of travel.

In some examples, components of the strap assembly 200 may be formed of various suitable materials, such as one or more plastics. For instance, the pivot clip 210 may be formed of polyamide and the slider clip 260 may be formed of acetal (POM). In another example, any of the pivot clip 210, strap 230, elastic band 240, shoulder strap 250, handle 252, and/or slider clip 260 may have a core formed of polyvinyl chloride and an outer portion formed of ethylene vinyl acetate. In other examples, any of the pivot clip 210, strap 230, elastic band 240, shoulder strap 250, handle 252, and/or slider clip 260 may be formed of rope (such as polyester rope), or a nylon webbing. In yet other examples, any of the pivot clip 210, strap 230, elastic band 240, shoulder strap 250, handle 252, and/or slider clip 260 may be constructed of various materials, such as one or more metals, alloys, polymers, ceramics, or fiber-reinforced materials. In still other examples, the handle 252 and/or strap 230 may include padding to facilitate easier carrying via the shoulder or by hand.

FIGS. 6A-6F depict a pivot assembly 300, which represents either of pivot assemblies 300A, 300B. The pivot assembly 300 may be located on either side of the insulating container 100. As illustrated in FIGS. 6A-6D, the pivot assembly may include one or more of a pivot insert block 310, a pivot standoff plate 330, an outer pivot 350, and a fastener 370. In some examples, the pivot assembly 300 and any of the pivot insert block 310, the pivot standoff plate 330, the outer pivot 350, and the fastener 370 may be formed from acetal (POM). In another example, the pivot assembly 300 and any of the pivot insert block 310, the pivot standoff plate 330, the outer pivot 350, and the fastener 370 may include a core formed of polyvinyl chloride and an outer portion formed of ethylene vinyl acetate.

The pivot insert block 310 may be integrally molded in the base portion 102 of the insulating container 100. The pivot insert block 310 may include a front surface 312 and an opposing rear surface 314. The pivot insert block 310 may include multiple ribs 316 extending from a rear surface 314 of the pivot insert block 310. The multiple ribs 316 extending from the rear surface 314 may provide support and stability for the pivot assembly 300 within the base portion 102 of the insulating container 100. The pivot insert block 310 may also include one or more positioning slots 318 located on the front surface 312 of the pivot insert block 310. The one or more positioning slots 318 may be configured to receive the protrusions or tabs 356 on the outer pivot 350. The one or more positioning slots 318 may be spaced and shaped to correspond to the positioning slots 332 in the pivot standoff plate 330 and the protrusions or tabs 356 on the outer pivot 350.

Additionally, the pivot insert block 310 may also include a fastener recess 319 that extends through the front surface 312 and may be configured to receive the fastener 370. The fastener recess 319 may include internal threads to threadedly engage with threads 372 on the fastener 370. The fastener recess 319 may be located in the approximate center of the pivot insert block 310. The fastener recess 319 may extend from the front surface 312 towards the rear surface 314 of the pivot insert block 310 through the pivot insert block 310.

Figure 6A:
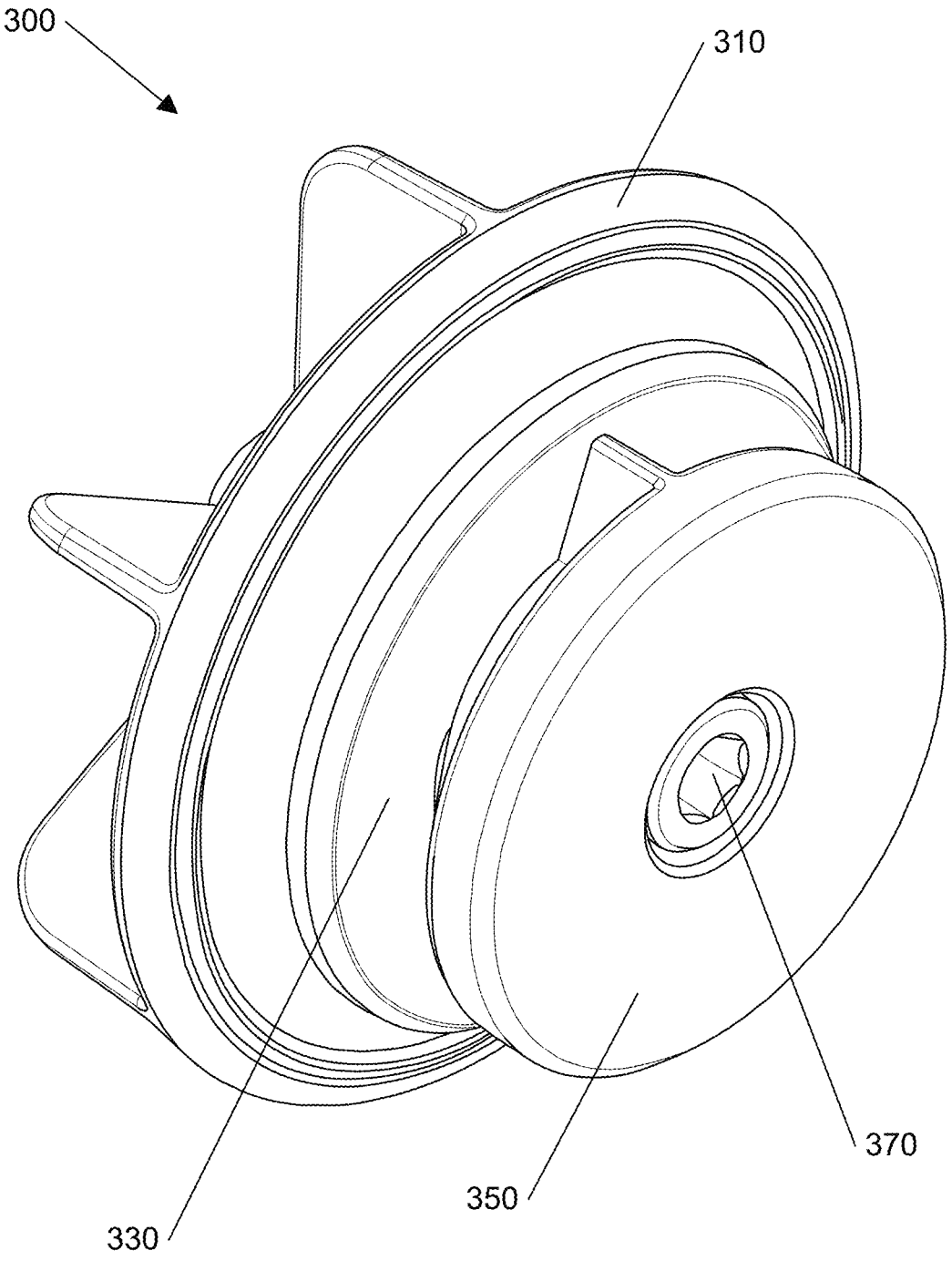
FIG. 6A is a front perspective view of a pivot assembly from the insulating container depicted in FIG. 1A according to one or more aspects described herein.
Figure 6B:
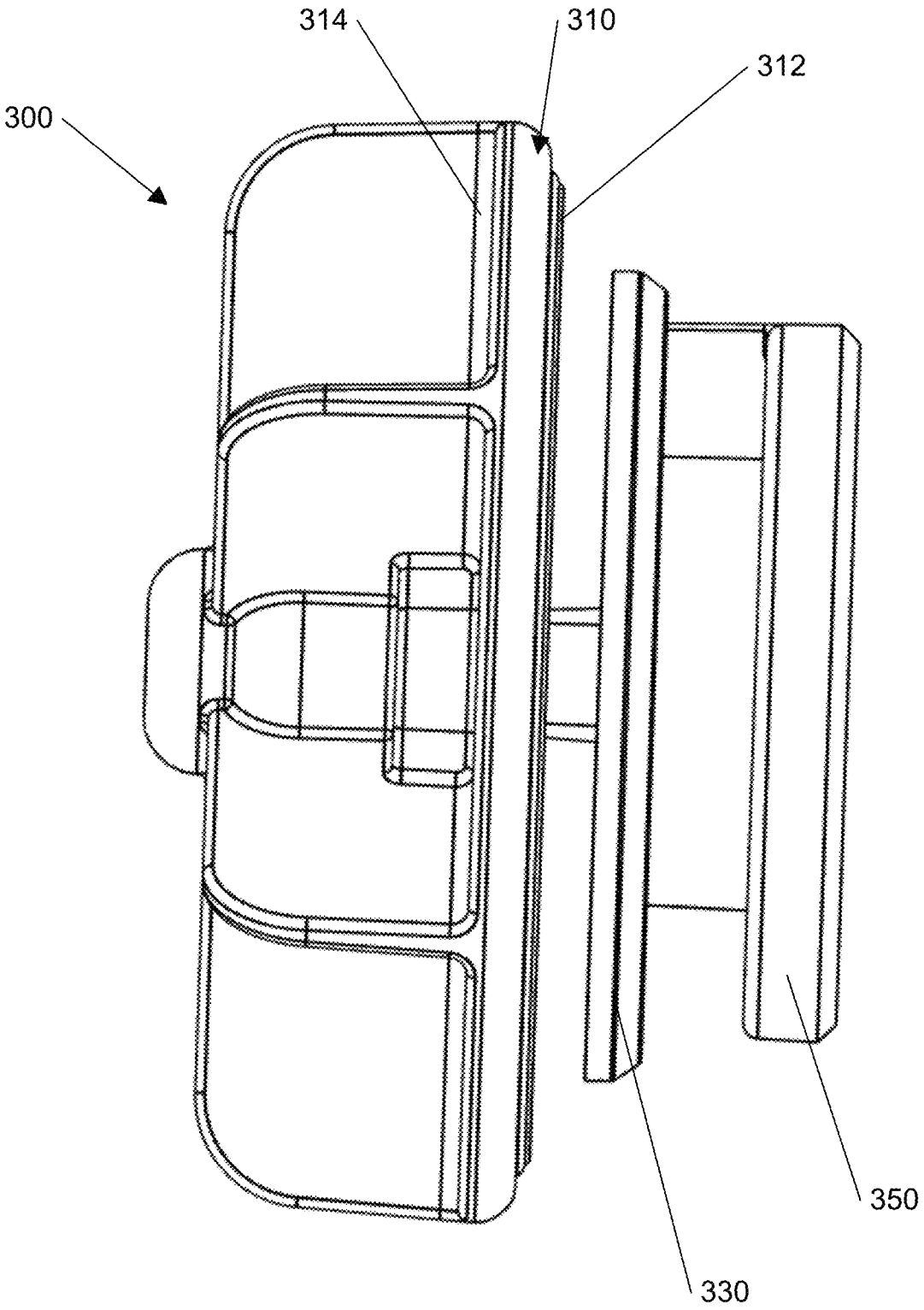
FIG. 6B is a side view of the pivot assembly depicted in FIG. 6A according to one or more aspects described herein.
Figure 6C:
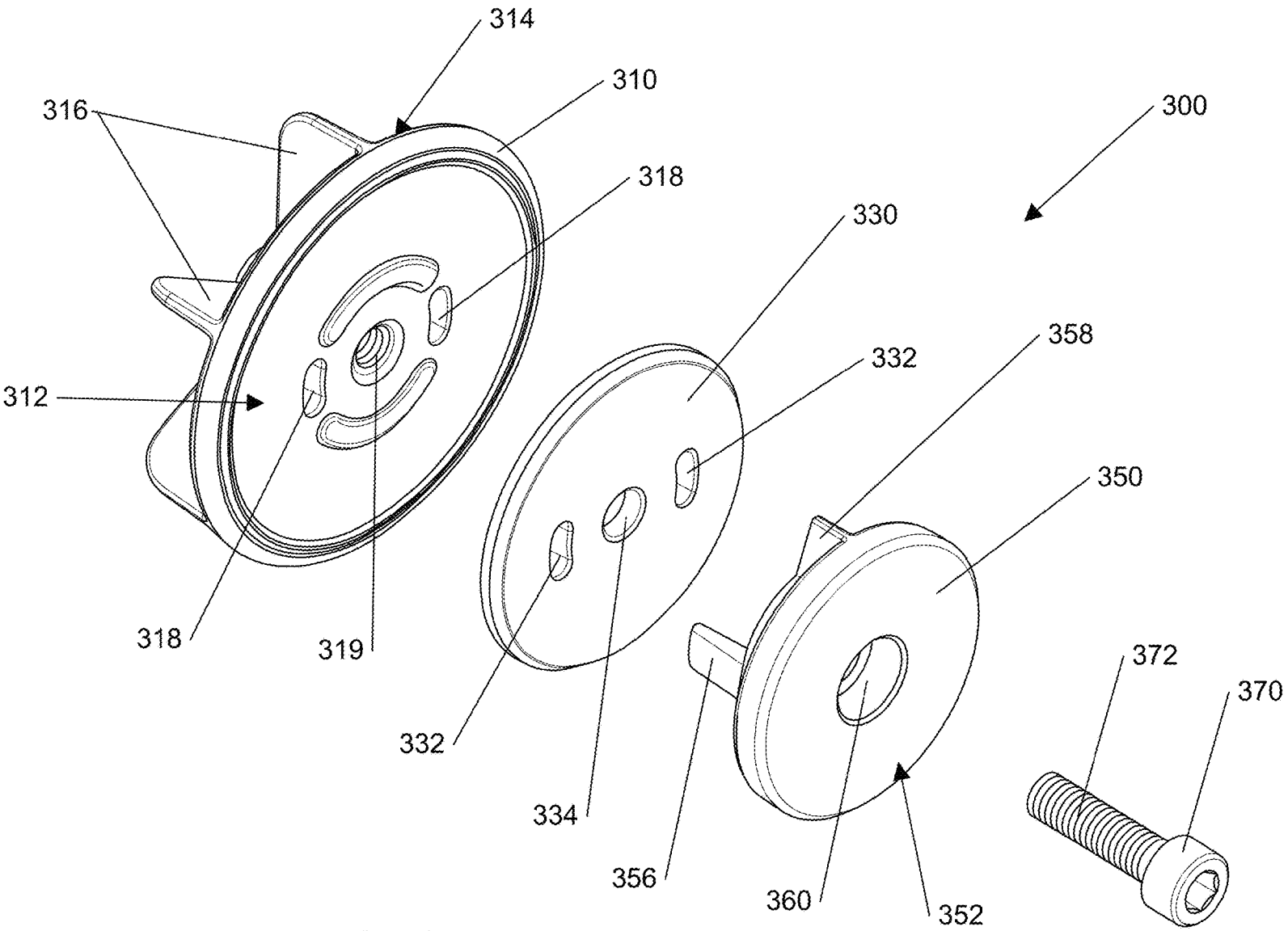
FIG. 6C is a perspective exploded component view of the pivot assembly depicted in FIG. 6A according to one or more aspects described herein.
Figure 6D:
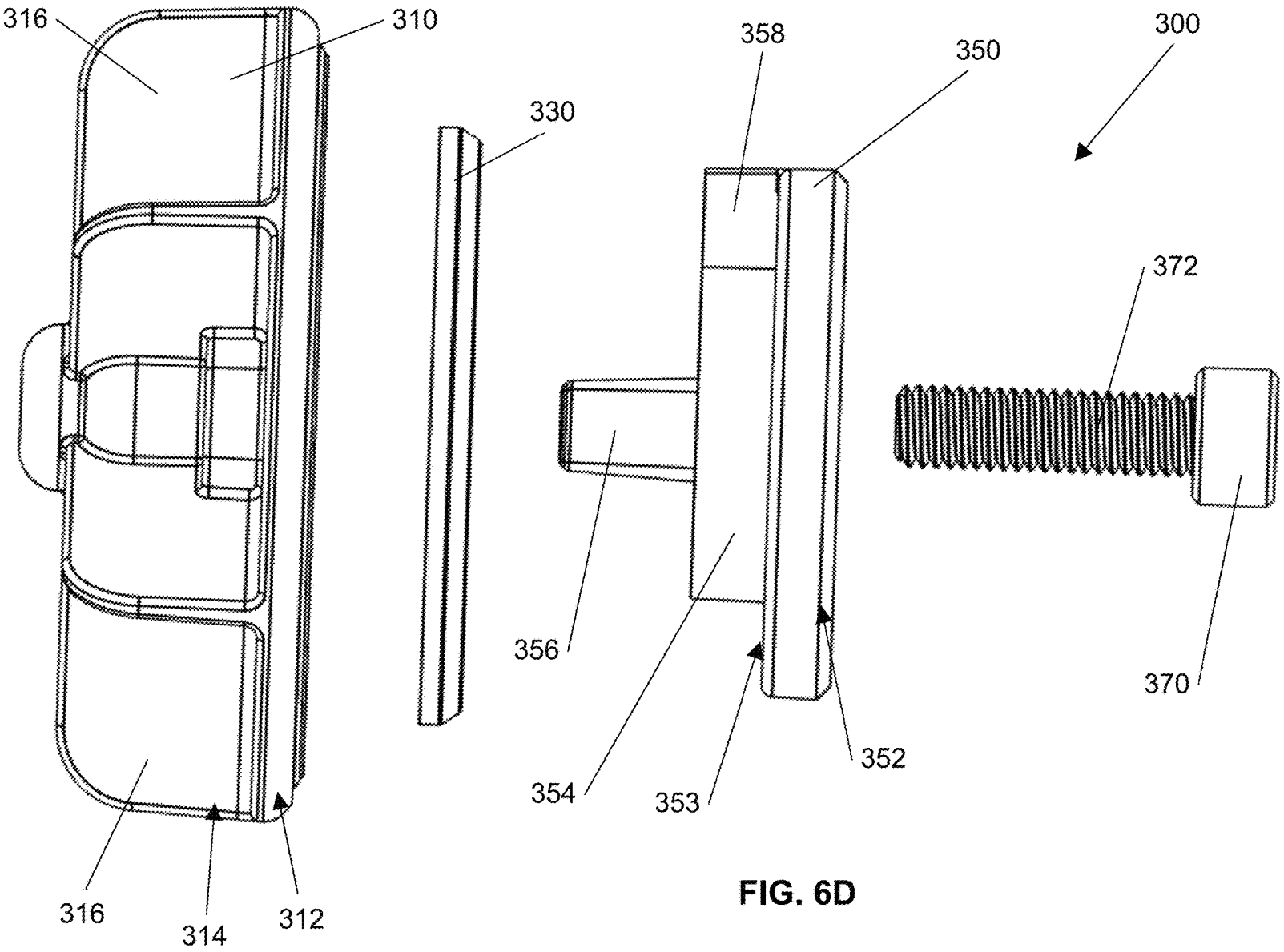
FIG. 6D is a side exploded component view of the pivot assembly depicted in FIG. 6A according to one or more aspects described herein.
Figure 6E:
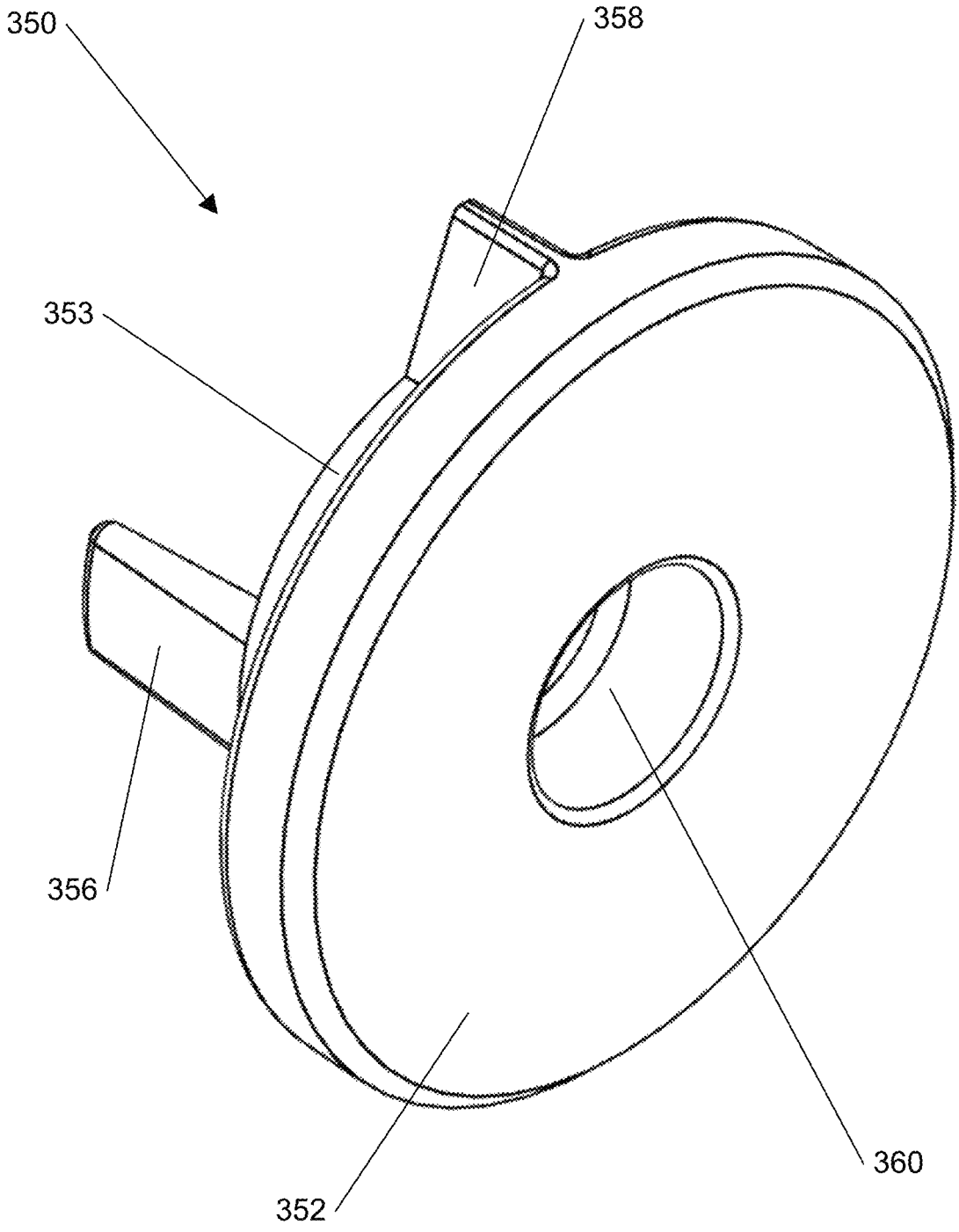
FIG. 6E is a front perspective view of the outer pivot post from the pivot assembly depicted in FIG. 6A according to one or more aspects described herein.
Figure 6F:
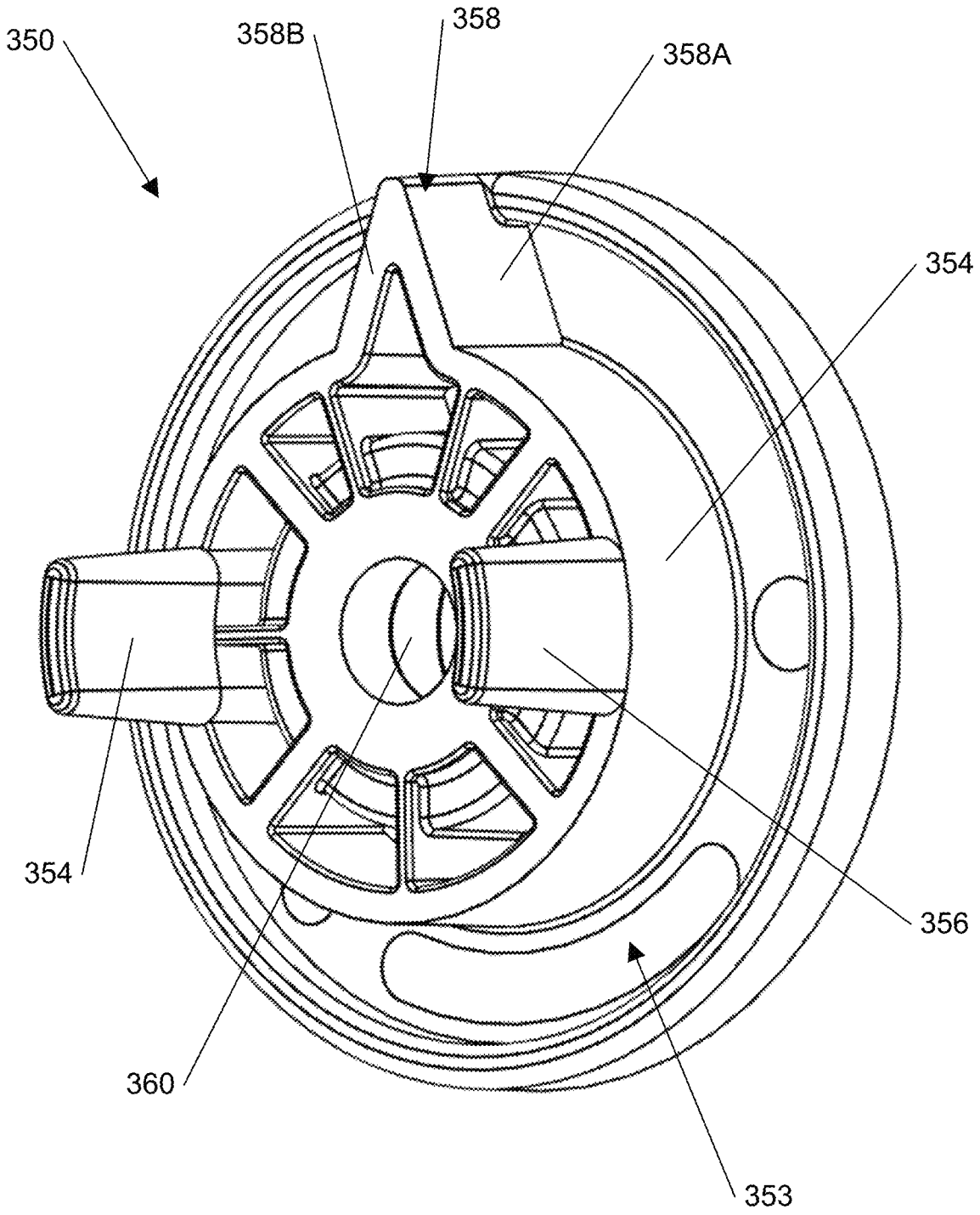
FIG. 6F is a rear perspective view of the outer pivot post from the pivot assembly depicted in FIG. 6A according to one or more aspects described herein.

The pivot assembly 300 may include an engagement between an outer pivot 350 and the pivot insert block 310, as illustrated in FIGS. 6A-6D. FIGS. 6E and 6F illustrate the outer pivot 350 separately. As illustrated in FIGS. 6A-6F, the outer pivot 350 may include a front surface 352, a rear surface 353 opposite the front surface, and a center post 354 extending from the rear surface 353. The center post 354 may be configured to engage the pivot clip 210 and specifically the receptacle 220 from the pivot clip 210. The engagement between the receptacle 220 from the pivot clip 210 and the center post 354 from the pivot assembly 300 secures the strap assembly 200 to the container 100. The engagement between the receptacle 220 from the pivot clip 210 and the center post 354 from the pivot assembly 300 also provides the pivoting and rotation of the strap assembly 200 with the container 100.

The outer pivot 350 may be configured to engage the pivot insert block 310. The outer pivot 350 may include protrusions or tabs 356. The protrusions or tabs 356 may extend to the rear of the outer pivot 350 from or around the center post 354. As illustrated in FIGS. 6A-6F, the outer pivot 350 may include two protrusions or tabs 356 extending from the center post 354. The pivot insert block 310 may also include one or more positioning slots 318 located on the front surface 312 of the pivot insert block 310. The protrusions or tabs 356 of the outer pivot 350 may be spaced and shaped to slide into and through the positioning slots 318 located on the front surface 312 of the pivot insert block 310. The protrusions or tabs 356 of the outer pivot 350 may be also spaced and shaped to slide through the positioning slots 332 in the pivot standoff plate 330.

Figure 7A:
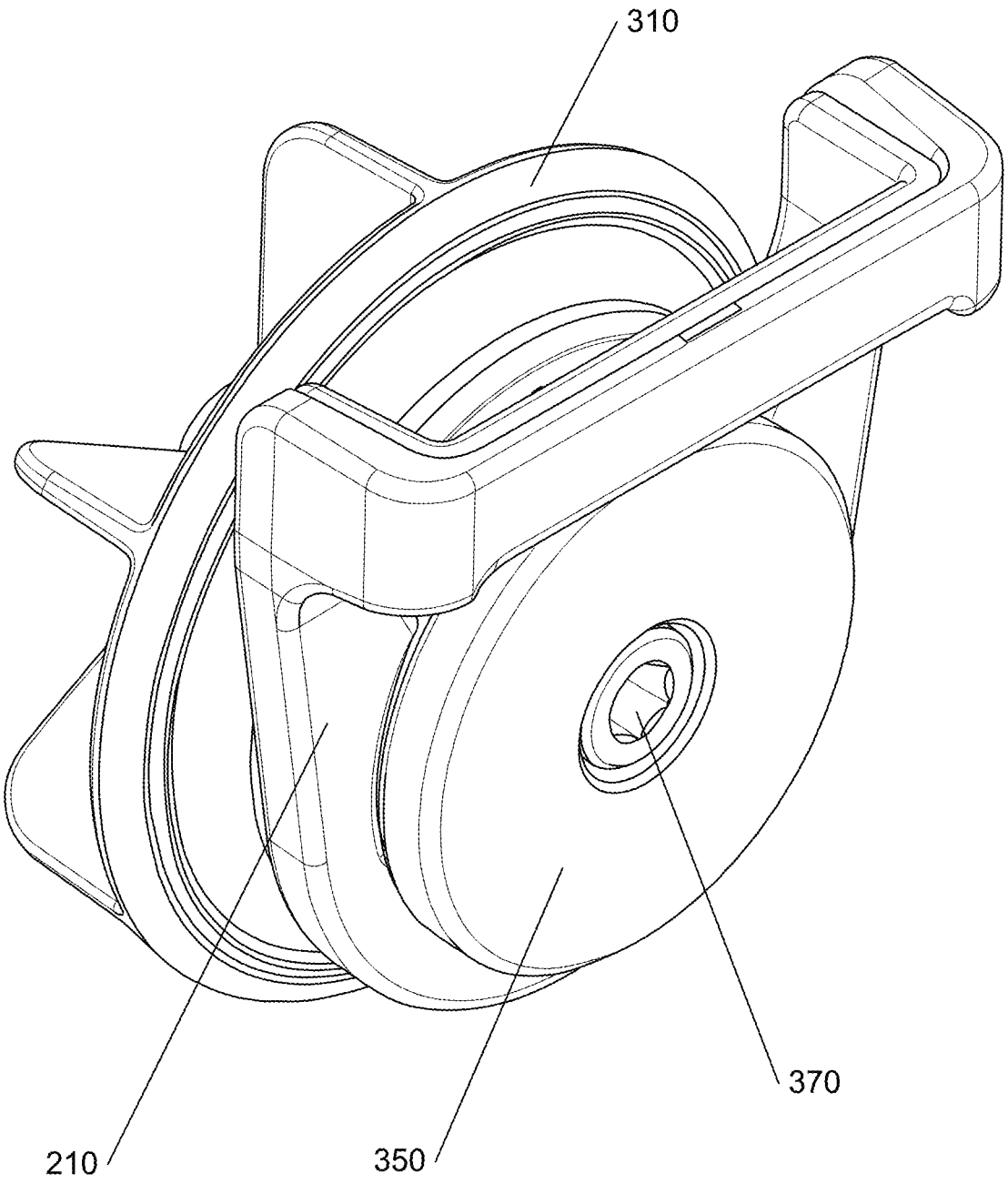
FIG. 7A is a front perspective view of the pivot assembly depicted in FIG. 6A connected with the pivot clip from the strap assembly according to one or more aspects described herein.
Figure 7B:
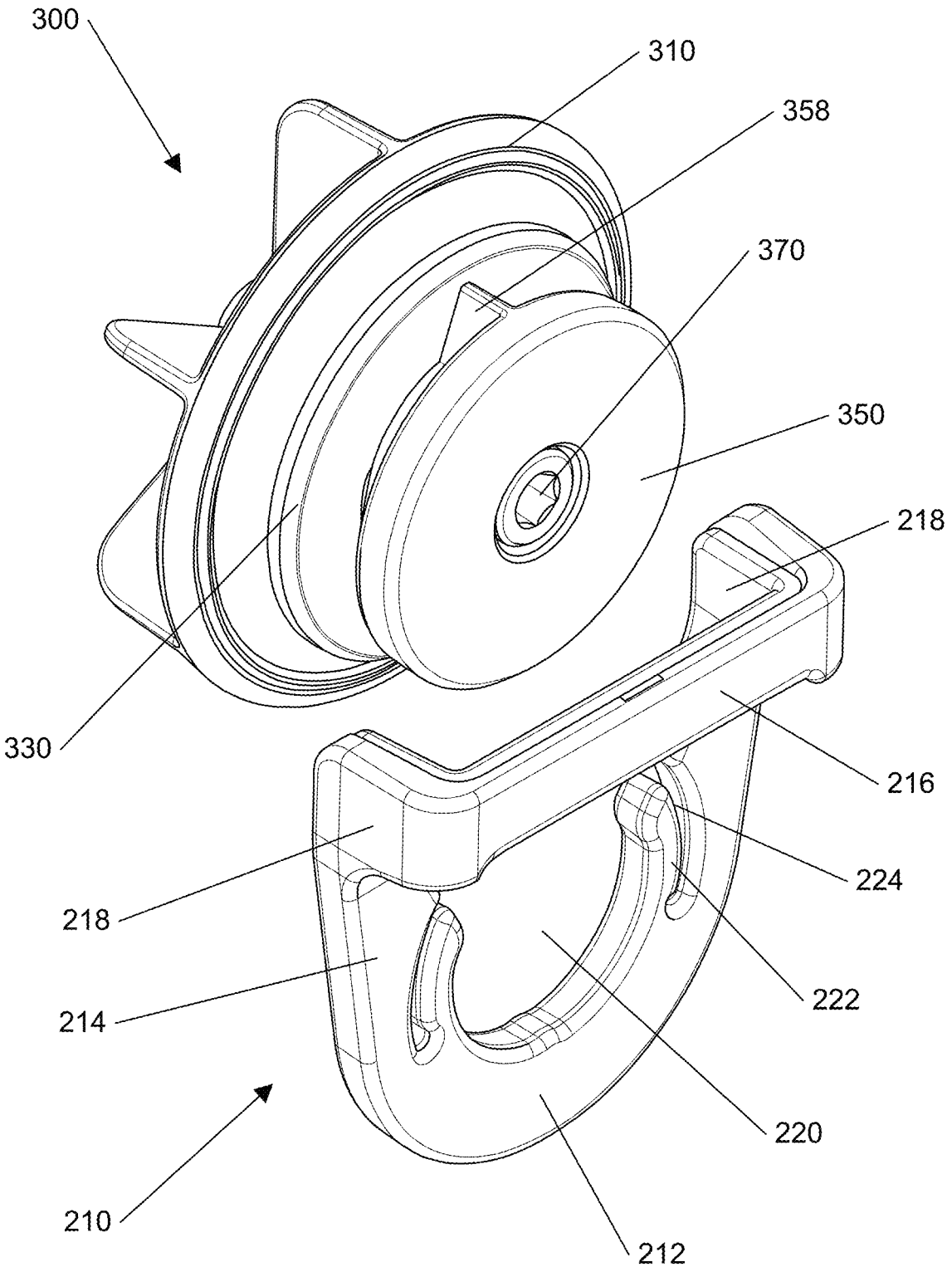
FIG. 7B is a front perspective view of the pivot assembly depicted in FIG. 6A with the pivot clip disconnected according to one or more aspects described herein.
Figure 7C:
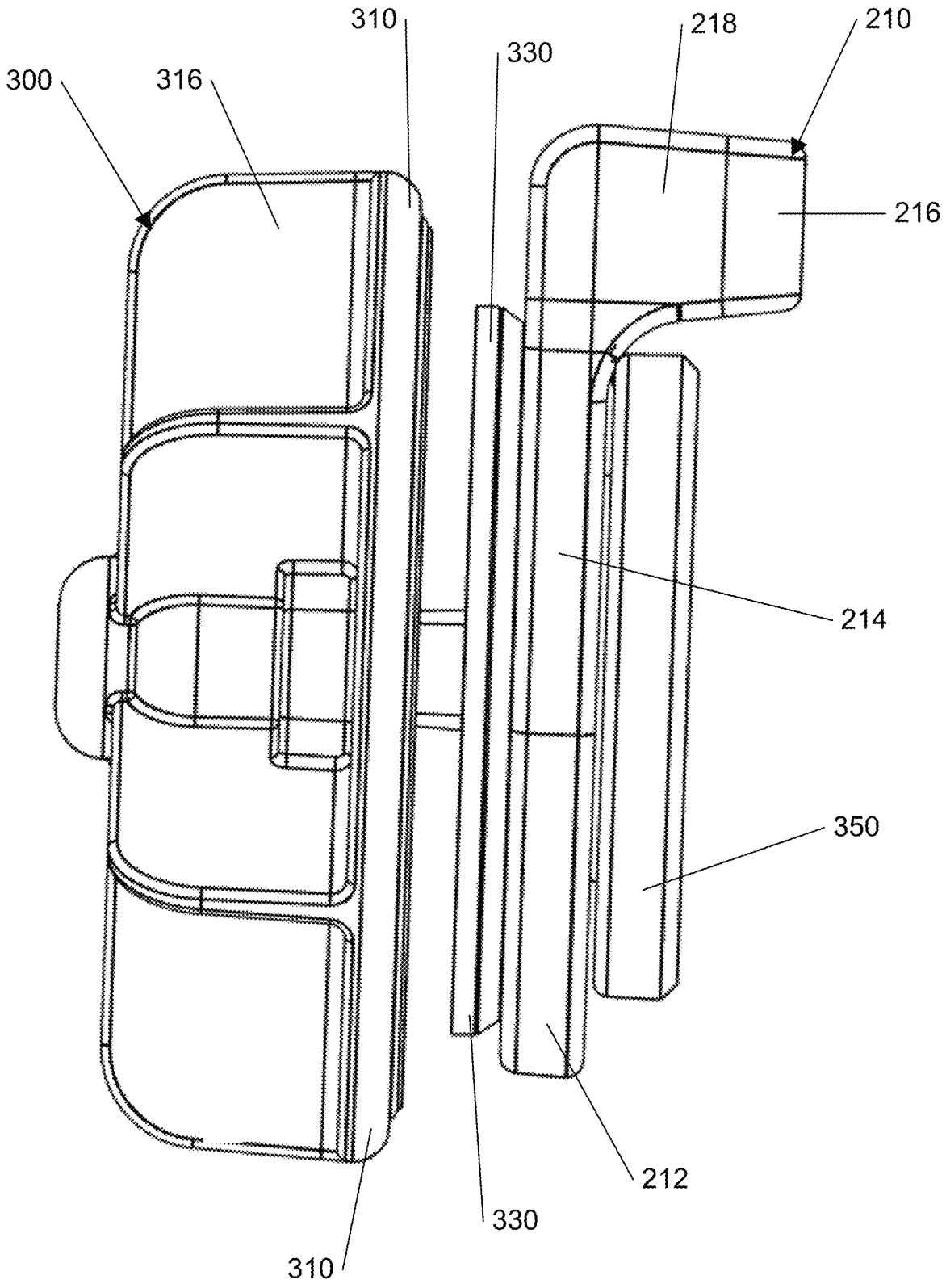
FIG. 7C is a side view of the pivot assembly depicted in FIG. 6A connected with the pivot clip from the strap assembly according to one or more aspects described herein.
Figure 7D:
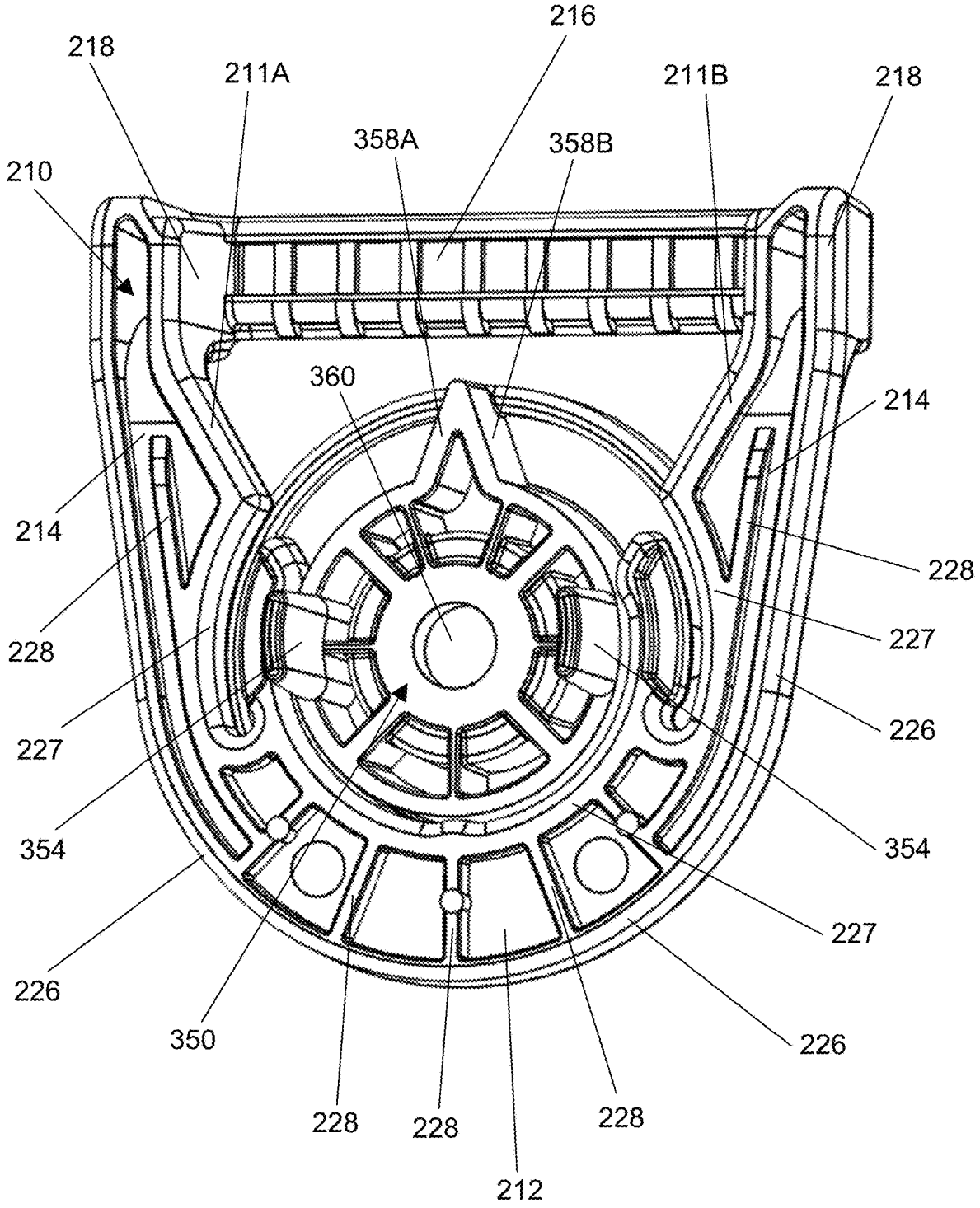
FIG. 7D is a rear perspective view of the pivot clip engaged with the outer pivot according to one or more aspects described herein.

Additionally, the outer pivot 350 may include one or more stops 358 that are configured to engage the one or more stop surfaces 211 on the pivot clip 210. The one or more stop 358 may be in the form of a protrusion from the center post 354. The one or more stops 358 may be a protrusion from other locations within the outer pivot 350. As illustrated in FIG. 6F, the outer pivot 350 includes a stop 358 that extends and protrudes from a center top location along the center post 354 and has a triangular shape to engage with the stop surfaces 211 on the pivot clip 210 when the strap assembly 200 is engaged with the pivot assembly 300. Additionally, as shown in FIG. 7D, the stop 358 may include a first stop surface 358A and a second stop surface 358B. The first stop surface 358A may engage a first stop surface 211A on the pivot clip 210 when the strap assembly 200 is rotated to the front of the insulating container 100. The second stop surface 358B may engage a second stop surface 211B on the pivot clip 210 when the strap assembly 200 is rotated to the rear of the insulating container 100. When the strap assembly 200 is engaged with the pivot assembly 300, the rotation of the strap assembly 200 may be limited by the engagement of the one or more stops 358 with the one or more stop surfaces 211 on the pivot clip 210 when the strap assembly 200 is rotated from the front and the back of the container 100. The one or more stops 358 on the outer pivot 350 are configured to engage the stop surfaces 211 on the pivot clip 210 when the pivot clip 210 engages the outer pivot 350 and pivot assembly 300. The configuration and geometry of the pivot clip 210 and the pivot 350 may prevent the strap assembly 200 from rotating under the insulating container 100.

Additionally, the outer pivot 350 may also include a fastener hole 360 that extends through the outer pivot 350 and may be configured to receive the fastener 370 as will be explained below. The fastener hole 360 may include smooth internal surfaces so that the fastener 370 can freely slide through the fastener hole 360 of the outer pivot 350. The fastener hole 360 may be located in the approximate center of the outer pivot 350.

In some examples, the pivot assembly 300 may include a pivot standoff plate 330. The pivot standoff plate 330 may provide an additional component to provide a bearing surface for the pivot clip 210 installation on the pivot assembly 300 for improved installation and retention. The pivot standoff plate 330 may be a circular disc that is located between the pivot insert block 310 and the outer pivot 350. The pivot standoff plate 330 may also include one or more positioning slots 332 that extend through the pivot standoff plate 330. The one or more positioning slots 332 may be spaced and shaped to correspond to the positioning slots 318 in the pivot insert block 310 and protrusions or tabs 356 on the outer pivot 350. Additionally, the pivot standoff plate 330 may also include a fastener hole 334 that extends through the pivot standoff plate 330 and may be configured to receive the fastener 370 as will be explained below. The fastener hole 334 may include smooth internal surfaces so that the fastener 370 can freely slide through the fastener hole 334 of the pivot standoff plate 330. The fastener hole 334 may be located in the approximate center of the pivot standoff plate 330.

The pivot standoff plate 330 may help minimize scratching during the installation and clipping of the pivot clip 210 on the pivot assembly 300. The pivot standoff plate 330 may also help provide adequate clearance for the pivot clip 210 corners.

In some examples, the outer pivot 350 and pivot assembly 300 is secured to the base portion 102 and pivot insert block 310 by a fastener 370. In certain examples, the pivot fastener 370 may be a screw, bolt, rivet, etc. In particular, a rotatable coupling between the strap assembly 200 and the container 100 may be facilitated by the fastener 370. In one implementation, the fastener 370 may act as a bearing about which the strap assembly 200 may rotate relative to the container 100. In one implementation, the fastener 370 may comprise a screw configured to be received through the fastener hole 360 on the outer pivot 350, through the fastener hole 334 on the standoff plate 330, and threaded into the fastener recess 319 on the pivot insert block 310. However, additional or alternative fastening mechanisms that may be utilized to couple the outer pivot 350 and pivot assembly 300 to the container 100, without departing from the scope of the disclosures described herein.

It is understood that the pivot assembly 300 may have different structures in other embodiments, and may have structures that are complementary with the structures of the pivot clip 210 and strap assembly 200 to facilitate connection.

Additionally or alternatively, the insulating container may include a drain assembly 400 that is located and installed within a pass through of the wall of the insulating container 100.

Figure 11A:
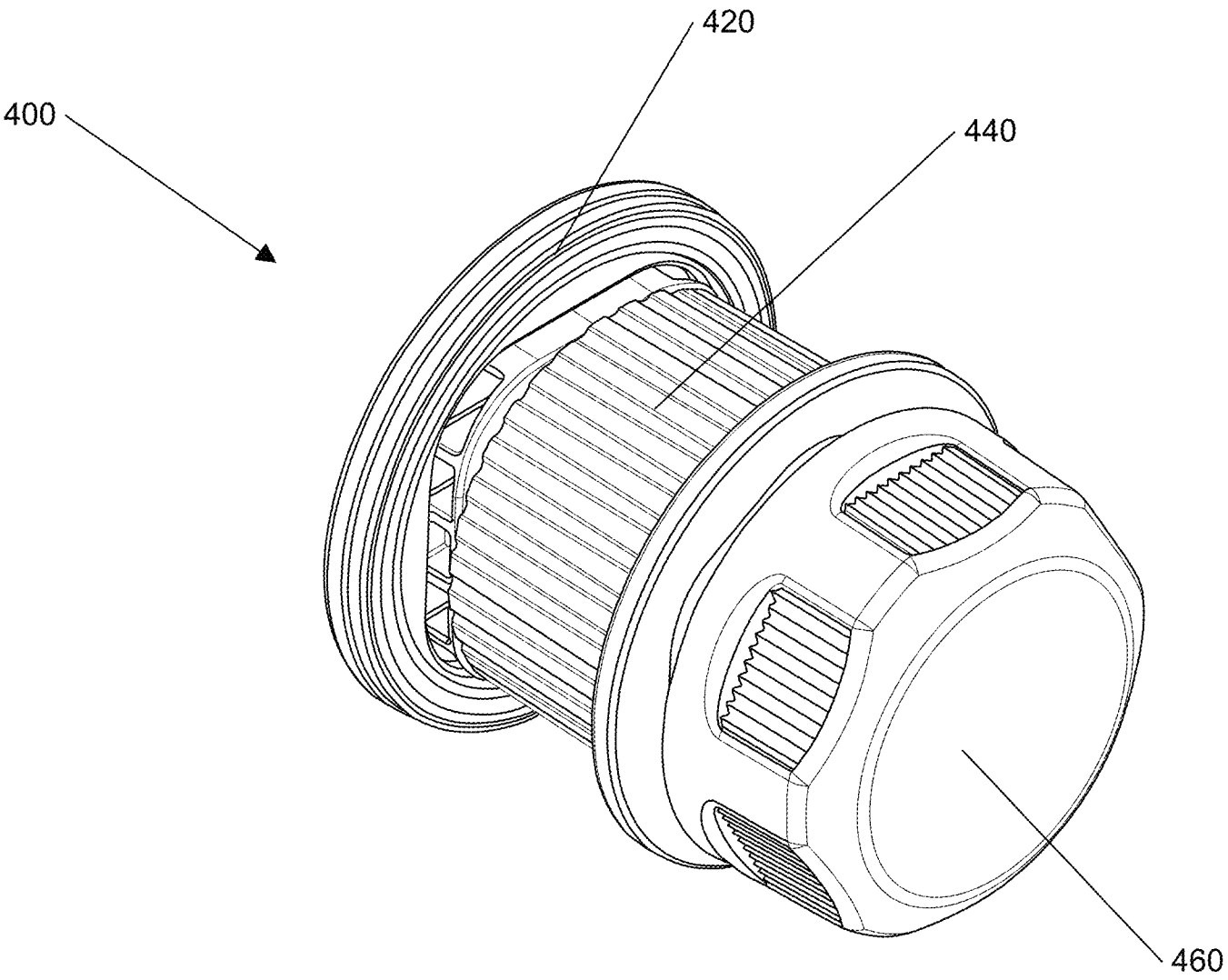
FIG. 11A is a front perspective view of the drain assembly from the insulating container depicted in FIG. 1A according to one or more aspects described herein.
Figure 11B:
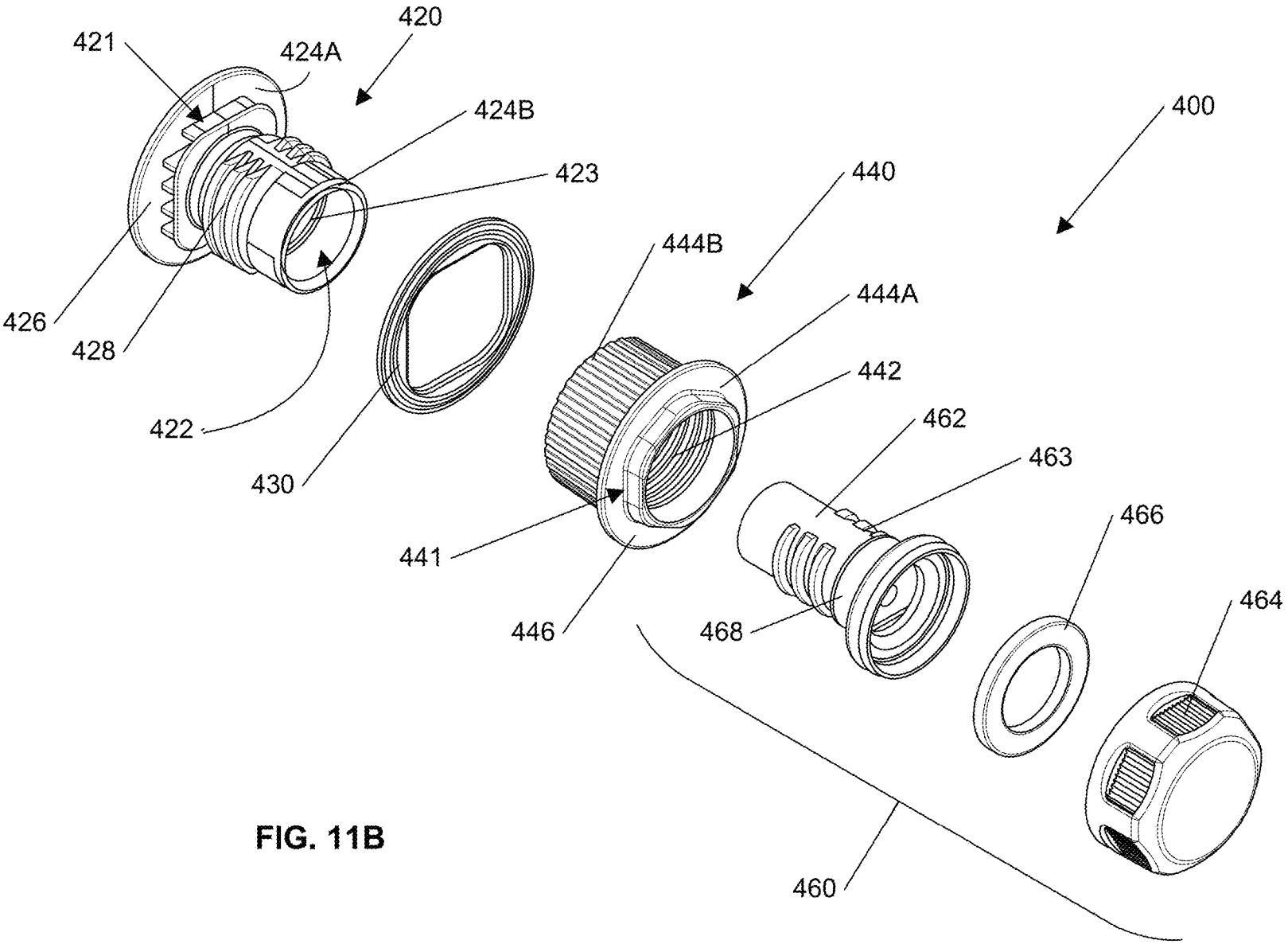
FIG. 11B is a front perspective exploded component view of the drain assembly depicted in FIG. 11A according to one or more aspects described herein.

As shown in FIGS. 11A and 11B, the drain assembly 400 may include a main tube 420, an outer tube 440, a sealing gasket 430, and a drain plug assembly 460. The drain assembly 400 may be located and installed within a pass through of the wall of the base portion 102. In the illustrated embodiment, the drain assembly 400 may be located on a side portion 114 adjacent to the bottom surface 108 of the insulating container 100. The drain assembly 400 may be installed and located within a drain plug inset within the insulating container 100.

The main tube 420 may include a drain pass-through portion 422 extending from a first end 424A to an opposite second end 424B. The drain pass-through portion 422 may include an internal threaded connection 423 that extends from the first end 424A to the second end 424B to engage with the drain plug assembly 460. The main tube 420 may include a main tube rim 426 located on the first end 424A with an external threaded connection 428 located between the main tube rim 426 and the second end 424B. The main tube 420 may also include a gasket (not shown) that provide compression between the main tube 420 and the inner wall of the base 102. The gasket may be a separate component or the gasket may be molded into the main tube 420. The gasket may be a softer material, such as silicone, while the main tube 420 is a more rigid material.

The outer tube 440 may be configured to threadedly engage with and connect to the main tube 420. The outer tube 440 may include an internal threaded connection 442. The outer tube 440 may include a first end 444A and an opposite second end 444B. The outer tube 440 may include an outer tube rim 446 located on the first end 444A with the internal threaded connection 442 extending within the outer tube 440 between the outer tube rim 446 and the second end 444B.

The outer tube 440 may also include a sealing gasket 430 that is inherent to the outer tube rim 446 of the outer tube 440. The sealing gasket 430 may contact a rear side portion and a base outer wall structure of the base 102 and container 100. The sealing gasket 430 may prevent liquid from escaping the insulating container 100 between the drain assembly 400 and the cooler base 102. The sealing gasket 430 may be a singular ring concentric about an axis of the outer tube 440. The sealing gasket 430 may also include multiple rings or non-circular.

As shown in FIGS. 11A and 11B, the main tube 420 and the outer tube 440 may engage to form a portion of the drain assembly 400. The main tube 420 and the outer tube 440 may pass through the rear side portion, a base inner wall structure, and a base outer wall structure of the container 100. The main tube 420 and the outer tube 440 may cooperatively engage with each other. The main tube 420 may be installed first, using a rectangular fitting 421 with flats on the main tube 420 that mate with a rectangular opening in the rear side portion and inner wall of the base 102 of the container 100. This rectangular fitting 421 may prevent rotation of the drain assembly 400 relative to the base 102. The outer tube 440 may then be screwed onto the main tube 420 with the external threaded connection 428 of the main tube 420 engaging with the internal threaded connection 442 on the outer tube 440. The outer tube 440 may include a flat head structure 441 to allow for tools to tighten the outer tube 440 into the main tube 420. The flat head structure 441 may be any polygon shape with one or more flat sides, such as for example, square, pentagon, hexagon, or other polygon shapes. The flat head structure 441 may also include curved sides. The flat head structure 441 may be any shape with one or more flat sides. The outer tube 440 may have bottom out features with a specific length that stops the threaded connection between the main tube 420 and the outer tube 440 and against inner wall/face of the base 102 of the container 100. The bottom out features may set the distance of the inner wall and the outer wall of the base 102 of the container 100.

When the outer tube 440 is fully screwed onto the main tube 420, the drain plug assembly 460 may be screwed into the main tube 420. The drain plug assembly 460 may include a drain plug body 462, a drain plug cap 464, and a drain plug gasket 466. The drain plug body 462 may include external threads 463 that extend along the drain plug body 462. The drain plug cap 464 may be connected an end of the drain plug body 462 with the drain plug gasket 466 in between the drain plug cap 464 and the drain plug body 462. The drain plug assembly 460 may be screwed and/or unscrewed to control the flow through the drain assembly 400, wherein unscrewing the drain plug assembly 460 opens the drain assembly 400 and screwing the drain plug assembly 460 closes the drain assembly. Additionally, as shown in FIG. 11B, the drain plug assembly 460 and specifically the drain plug body 462 may include vortex drainage holes 468. The vortex drainage holes 468 may be located on an upper portion of the drain plug body 462 near the drain plug cap 464. The vortex drainage holes 468 may help allow liquid to drain through the drain plug assembly 460 without the drain plug body 462 being fully removed from the drain assembly 400.

Additionally or alternatively, securing systems or devices may be used to secure the lid 104 to the base. Insulating container 100 may include latching devices 120 and keepers 140 of the base 102 on the front of the container, as shown in at least FIGS. 1B, 2A, 2B, and 4, to secure the lid 104 in the closed position. The latching devices 120 may engage the keeper 140 to lock the lid 104 to the base 102 when the container 100 is in a closed configuration. The latch and keepers may be similar to the latch assemblies described in U.S. patent application Ser. No. 16/006,344 filed on Jun. 12, 2018; U.S. application Ser. No. 16/218,089 filed Dec. 12, 2018; and U.S. patent application Ser. No. 17/123,746 filed on Dec. 16, 2020, which are incorporated by reference in their entirety.

Various venting or pressure regulation arrangements may be used without departing from the invention. The venting or pressure regulation may regulate the internal pressure of the interior void with the external atmospheric pressure. A pressure regulation device may be permanently affixed or removably inserted into the base portion.

The insulating containers described herein include various features that ensure easy and efficient manufacture of the insulating containers, while providing durability and wear resistance. The insulating containers and the various integrally molded features, such as side pocket handles, pressure regulation mechanisms or devices, latch devices, etc., may be advantageous in improving durability and wear resistance.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. An insulating container, comprising:

a base;

a lid hingedly attached to the base;

the base including:

a sidewall structure having a front sidewall, a rear sidewall opposite the front sidewall, and two lateral sidewalls between the front sidewall and the rear sidewall;

a bottom portion connected to a first end of each sidewall of the sidewall structure, the bottom portion being configured to support the insulating container on a surface; and an opening formed at a second end of each sidewall of the sidewall structure, opposite the first end of each sidewall of the sidewall structure, the opening being configured to allow access to an interior void of the insulating container formed by the sidewall structure and the bottom portion, wherein a gasket is configured to provide a water-resistant seal when the lid is in a closed and secured position; and a removable strap assembly including:

a pivot assembly having an outer pivot post located on both of the two lateral sidewalls of the base, and a pivot clip attached to an end of a strap, wherein the pivot clip includes a receptacle configured to slide over and receive the outer pivot post to connect the strap to the insulating container, and wherein the pivot clip and the strap freely rotate from a front of the insulating container to a rear of the insulating container, wherein the pivot clip further includes resilient arms that provide a locking mechanism when sliding the pivot clip over the pivot assembly and securely attaching the pivot clip to the pivot assembly.

2. The insulating container of claim 1, wherein the pivot clip includes a base portion, a strap arm, and a transverse portion extending between the base portion and the strap arm, and wherein the strap arm is configured to hold the end of the strap.

3. The insulating container of claim 2, wherein the resilient arms are spaced from the transverse portion defining a gap between the resilient arms and the transverse portion, wherein the receptacle and resilient arms have an arced shape that arcs upward from the base portion on both sides of the pivot clip.

4. The insulating container of claim 2, wherein the pivot clip includes one or more stop surfaces located along the transverse portion of the pivot clip within the receptacle, the one or more stop surfaces configured to engage with a stop located on the pivot assembly to limit the rotation of the pivot clip relative to the pivot assembly.

5. The insulating container of claim 4, wherein the stop is located on the outer pivot post and extends from a center top location of the outer pivot post and has a triangular shape to engage with the one or more stop surfaces on the pivot clip.

6. The insulating container of claim 2, wherein the strap arm is offset and extends from the transverse portion with one or more offset arms.

7. The insulating container of claim 1, wherein the pivot assembly includes a pivot insert block located within the lateral sidewalls of the base, the pivot insert block comprising:

one or more positioning slots located on a front surface of the pivot insert block, the one or more positioning slots configured to receive protrusions on the outer pivot post when connecting the outer pivot post to the pivot insert block; and a fastener recess located in an approximate center of the pivot insert block, the fastener recess includes internal threads to engage with a fastener that extends through and connects the outer pivot post to the pivot insert block.

8. The insulating container of claim 7, wherein the pivot insert block includes multiple ribs extending from a rear surface that provide stability for the pivot assembly within the base.

9. The insulating container of claim 7, wherein the pivot assembly includes a pivot standoff plate that provides a bearing surface for the pivot clip and is located between the pivot insert block and the outer pivot post, wherein the pivot standoff plate comprises:

one or more positioning slots that extend through the pivot standoff plate and are spaced and shaped to correspond to the positioning slots on the pivot insert block and the protrusions on the outer pivot post; and a fastener hole located in an approximate center of the pivot standoff plate, the fastener hole allows the fastener to freely slide through the pivot standoff plate to connect the outer pivot post to the pivot insert block.

10. An insulating container, comprising:

a base;

a lid hingedly attached to the base;

the base including:

a sidewall structure having a front sidewall, a rear sidewall opposite the front sidewall, and two lateral sidewalls between the front sidewall and the rear sidewall;

a bottom portion connected to a first end of each sidewall of the sidewall structure, the bottom portion being configured to support the insulating container on a surface; and an opening formed at a second end of each sidewall of the sidewall structure, opposite the first end of each sidewall of the sidewall structure, the opening being configured to allow access to an interior void of the insulating container formed by the sidewall structure and the bottom portion, wherein a gasket is configured to provide a water-resistant seal when the lid is in a closed and secured position; and at least one latch configured to secure the lid when the lid is in a closed position; and a strap assembly including:

a pivot assembly with an outer pivot post located on both of the two lateral sidewalls of the base, a pivot clip attached to an end of a strap, wherein the pivot clip slides over the outer pivot post to connect the strap assembly to the insulating container and the strap assembly freely rotates from a front of the insulating container to a rear of the insulating container, wherein the pivot clip further includes resilient arms that provide a locking mechanism when sliding the pivot clip over the pivot assembly and securely attaching the pivot clip to the pivot assembly, and a handle, wherein the strap assembly converts between a shoulder strap configuration and a handle configuration, wherein in the shoulder strap configuration, the strap has a first length that allows a user to carry the insulating container using the shoulder strap, and wherein in the handle configuration, the strap has a second length shorter than the first length that allows the user to carry the insulating container using the handle.

11. The insulating container of claim 10, wherein the pivot clip includes a base portion, a strap arm, and a transverse portion extending between the base portion and the strap arm, the strap arm configured to hold the end of the strap, the pivot clip further including a receptacle defined within the base portion configured to slide over and receive the outer pivot post to connect the strap assembly to the insulating container.

12. The insulating container of claim 11, wherein the resilient arms are spaced from the transverse portion defining a gap between the resilient arms and the transverse portion, wherein the receptacle and the resilient arms have an arced shape that arcs upward from the base portion on both sides of the pivot clip to provide the locking mechanism for the strap assembly when sliding the pivot clip over the outer pivot post and the pivot assembly.

13. The insulating container of claim 11, wherein the pivot clip includes one or more stop surfaces located along the transverse portion of the pivot clip within the receptacle, the one or more stop surfaces configured to engage with a stop located on the pivot assembly, wherein rotation of the strap assembly is limited by the engagement of the stop with the one or more stop surfaces on the pivot clip when the strap assembly is rotated from the front of the insulating container to the rear of the insulating container.

14. The insulating container of claim 13, wherein the stop is located on the outer pivot post and extends from a center top location along the outer pivot post and has a triangular shape to engage with the one or more stop surfaces on the pivot clip.

15. The insulating container of claim 11, wherein the strap arm is offset and extends from the transverse portion with one or more offset arms.

16. The insulating container of claim 10, wherein the pivot assembly includes a pivot insert block located within the lateral sidewalls of the base, the pivot insert block comprising:

one or more positioning slots located on a front surface of the pivot insert block, the one or more positioning slots configured to receive protrusions on the outer pivot post when connecting the outer pivot post to the pivot insert block; and a fastener recess located in an approximate center of the pivot insert block, the fastener recess includes internal threads to engage with a fastener that extends through and connects the outer pivot post to the pivot insert block.

17. The insulating container of claim 16, wherein the pivot insert block includes multiple ribs extending from a rear surface that provide stability for the pivot assembly within the base.

18. The insulating container of claim 16, wherein the pivot assembly includes a pivot standoff plate that provides a bearing surface for the pivot clip and is located between the pivot insert block and the outer pivot post, wherein the pivot standoff plate comprises:

one or more positioning slots that extend through the pivot standoff plate and are spaced and shaped to correspond to the positioning slots on the pivot insert block and the protrusions on the outer pivot post; and a fastener hole located in an approximate center of the pivot standoff plate, the fastener hole allows the fastener to freely slide through the pivot standoff plate to connect the outer pivot post to the pivot insert block.

19. The insulating container of claim 10, wherein the strap assembly comprises:

a first pivot clip that connects to a first lateral sidewall of the base, a first slider clip, and a first strap that connects to a first side of the shoulder strap; and a second pivot clip that connects to a second lateral sidewall of the base, a second slider clip, and a second strap that connects to a second side of the shoulder strap, wherein the first slider clip and the second slider clip are tri-glide slider clips that provide adjustable tension and a secure hold with the strap assembly, wherein each of the first slider clip and the second slider clip is rectangular-shaped with two side arms and a middle arm extending in between the two side arms forming two parallel slots.

* * * * *